US006345162B1

(12) United States Patent
Ozawa et al.

(10) Patent No.: US 6,345,162 B1
(45) **Date of Patent: *Feb. 5, 2002**

(54) IMAGE FORMING APPARATUS

(75) Inventors: Ichiro Ozawa, Funabashi; Yoshiaki Kobayashi, Numazu; Masaru Hibino, Ashigara; Masanori Shida, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/567,988

(22) Filed: May 10, 2000

(30) Foreign Application Priority Data

May 13, 1999 (JP) ..... 11-132368
Jul. 6, 1999 (JP) ..... 11-191515

(51) Int. Cl.[7] ..... G03G 15/06; G03G 15/00; G03G 15/30; G03G 15/02

(52) U.S. Cl. ..... 399/61; 399/43; 399/44; 399/58; 399/59; 399/149; 399/175

(58) Field of Search ..... 399/174, 175, 399/176, 149, 150, 94, 97, 58, 59, 53, 61, 30, 44, 43

(56) References Cited

U.S. PATENT DOCUMENTS 5,602,629 A * 2/1997 Saito et al. ..... 399/58
5,689,778 A * 11/1997 Hayakawa et al. ..... 399/174
5,754,926 A * 5/1998 Sakuraba et al. ..... 399/175
5,839,026 A * 11/1998 Ko ..... 399/174 X
5,933,681 A * 8/1999 Suzuki ..... 399/174 X
5,937,225 A * 8/1999 Samuels ..... 399/61 X
5,937,227 A * 8/1999 Wong et al. ..... 399/58 X
5,966,563 A * 10/1999 Kashihara ..... 399/175 X
6,163,670 A * 12/2000 Gomi et al. ..... 399/175

* cited by examiner

*Primary Examiner*—Susan S. Y. Lee
(74) *Attorney, Agent, or Firm*—Fitzpatrick, Cella, Harper & Scinto

(57) ABSTRACT

The present invention relates to an image forming apparatus which has an image bearing member for bearing a latent image, charging device for charging the image bearing member by bringing ears of electrically conductive particles into contact with the image bearing member, developing device for visualizing the latent image formed on the image bearing member as a toner image by using a developer containing toner and carrier after the image bearing member has been charged by the charging device, a permeability of the carriers being different from a permeability of the electrically conductive particles, density control device for controlling density of the developer within the developing device, the density control device detecting a permeability of the developer, comparing a detected signal value based on the detected result with a reference value, and controlling the density of the developer on the basis of the comparison result, and reference value correcting device for correcting the reference value, the reference value correcting device estimating an amount of the electrically conductive particles that enter within the developing device, and correcting the reference value on the basis of the estimated result.

38 Claims, 19 Drawing Sheets

LASER DRIVING PULSE

CLOCK PULSE

CLOCK PULSE NUMBER

ELECTROSTATIC LATENT IMAGE

IMAGE FORMING APPARATUS

BACKGROUND OF THE INVENTION

1. Field of the Invention

The present invention relates to an image forming apparatus such as a copying machine, a printer, a recording image display device or a facsimile machine in which an electrostatic latent image formed on an image bearing member is developed to form a visible image by using the electrophotographic system, the electrostatic recording system or the like.

In particular, the present invention relates to an image forming apparatus including a charging device which abuts against an image bearing member, a magnetic brush portion of a magnetic brush charging member having a magnetic brush portion formed by magnetically binding charge magnetic carrier particles, and applies a charge bias to the magnetic brush charging member to charge the image bearing member, an image information writing device that forms an electrostatic latent image on the charged image bearing member, a developing device that visualizes the electrostatic latent image as a toner image by using a two-component developer consisting of toner particles and developing magnetic carrier particles, and a transferring device which transfers the toner image onto a transfer material, in which the developing device serves as cleaning means that collects the toner remaining on the image bearing member after the toner image has been transferred onto the transfer material by the transferring member.

2. Related Background Art (A) Developing Device

In general, in a developing device (developing machine) equipped in an image forming apparatus of the electrophotographic system or the electrostatic recording system, there is used a two-component developer mainly containing toner particles and magnetic developing carrier particles (hereinafter referred to as "developing carriers"). In particular, in most of color image forming apparatuses that form a full-color or multi-color image by the electrophotographic system, the two-component developer is employed from the viewpoint of the color tone etc. of an image.

As well known, the toner density of the two-component developer (that is, the ratio of the toner weight to the total weight of the developing carrier particles and the toner particles) is extremely important in stabilization of the image quality. The toner particles in the developer are consumed during a developing process, and the toner density of the developer is varied. For that reason, it is necessary that the toner density of the developer is accurately detected by using a developer density control device (ATR), a toner is replenished in accordance with a change in the density of toner, the density of toner is always controlled to a constant value (T/D ratio control) and the quality of image is maintained.

In order to correct the above change in the developer density within a developer container of the developing device which is caused by developing, that is, in order to control the quantity of toner which is replenished to the developer, devices for detecting and controlling the toner density of the developer within the developer container have been variously proposed and put into practical use.

For example, the following devices have been employed:

(a) a developer density control device disposed in the vicinity of a developer bearing member (called "developer sleeve" in the following description, since there are generally many cases in which a developer sleeve is used) or a developer carrying path in the developer container, for detecting and controlling the density of toner by utilizing the fact that a reflectance of a light applied to a developer carried onto the developer sleeve, or a developer within the developer container differs depending on the density of toner;

(b) a developer density control device of the inductance detecting system designed such that an inductance head (sensor) for detecting an apparent permeability caused by the mixture ratio of magnetic developing carriers and non-magnetic toner particles to convert it into an electric signal, is located on a side wall of the developing device, the actual toner density of the developer within the developer container is detected according to a detected signal from the inductance head, and the toner is replenished according to a comparison of the actual toner density with a reference value; and (c) a developer density control device of the system in which a patch image density formed on an image bearing member (called "photosensitive drum" in the following description, since there are generally many cases in which a photosensitive drum is used) is read by using a light source and a patch sensor for receiving a reflected light from a surface thereof, located opposite to the surface of the photosensitive drum, converted into a digital signal by an analog-to-digital convertor, and thereafter is transmitted to a CPU. In the CPU, the patch image density thus converted into the digital signal is compared with an initial set value, and if the density is higher than the initial set value, the replenishment of the toner is then suspended until the density is returned to the initial set value. On the other hand, if the density is lower than the initial set value, the toner is forcedly replenished until the density is returned to the initial set value, as a result of which the density of toner is indirectly maintained to a desired value.

However, the system described in the above item (a) in which the density of toner is detected according to the reflectance of a light applied to a developer carried onto the developer sleeve or a developer within the developer container, suffers from the following problem. That is, if the detecting means is stained by scattered toner or the like, the density of toner cannot be accurately detected. Also, the system described in the above item (c) in which the density of toner is indirectly controlled according to the patch image density suffers from a problem in that a space where a patch image is formed or a space where the detecting means is located cannot be ensured with a downsized copying machine or image forming apparatus.

On the contrary, the inductance detecting system described in the above item (b) is regarded as the optimum toner density detecting system in the copying machine or image forming apparatus which is low in the cost and small in space, because the system is not affected by the above described problem of the spaces and problem of the stain due to the scattered toner in addition that the cost of a sensor unit is low.

The above developer density control device of the inductance detecting system (inductance detecting system ATR) controls the density of toner according to the following manner. That is, control is made such that the replenishment of toner starts if it is detected that the apparent permeability of the developer is large, since it means that the ratio of the developing carrier to the developer within a constant volume becomes high and the density of toner becomes lower. On the contrary, the replenishment of toner is suspended if it is detected that the apparent permeability of the developer is small, since it means that the ratio of the developing carrier to the developer within the constant volume becomes lower and the density of toner becomes higher.

(B) Magnetic Brush Charging Device

In general, a corona photosensitive member has been employed as charging means for an image bearing member such as an electrophotographic photosensitive member or an electrostatic recording dielectric equipped in the image forming apparatus of the electrophotographic system or the electrostatic recording system.

In recent years, because of having merits of low ozone, low electric power, etc., a contact charging device has been put into practical use, that is, a device of the system in which a charging member to which a voltage is applied is abutted against a member to be charged to allow the member to be charged. In particular, a device of the roller charging system using an electrically conductive roller as the charging member has been preferably employed from the viewpoint of the charging stability.

However, in the above-described roller charging system, because charging is conducted by discharging from the charging member to the member to be charged, the surface potential of the photosensitive member also fluctuates due to a fluctuation of the electric resistances of the charging roller and the electrophotographic photosensitive member, which is caused by a change in the environments.

Under the above circumstances, there has recently been proposed, as a charging system which is hardly influenced by a change in the environments, a method of conducting contact charging in such a manner that a voltage is applied to an electrically conductive contact charging member (a charging fur brush, a charging magnetic brush, a charging roller or the like) and charges identical in polarity with the potential of the photosensitive member are injected into the photosensitive member having on a surface thereof a charge injecting layer where electrically conductive powders ($SnO_2$ or the like) having a trap potential are dispersed.

The injection charging system is advantageous in that the supply voltage is satisfactorily the same degree as the potential of the photosensitive member, and no ozone that shortens the lifetime of the photosensitive member occurs, because not only the environmental dependency is small, but also discharge is not made.

Also, in the contact charging using discharge, in order to obtain a desired charge potential Vs for the member to be charged, it is necessary to apply, to the charging member, a DC (d.c.)(direct current) bias (Vs+Vth) resulting from adding a discharge start voltage Vth (the supply voltage of the contact charging member when the member to be charged starts to be charged by applying a d.c. voltage to the contact charging member) to the desired charge potential Vs. However, in the charge injection charging, because the charge potential Vs substantially identical with the DC bias applied to the charging member is obtained, a power supply for charging can be reduced in the cost.

As the contact charging member in case of the charge injecting system, the magnetic brush charging member or the fur brush charging member is preferably employed from the viewpoints of the charge and contact stability.

The magnetic brush charging member includes a magnetic brush portion of charged magnetic carrier particles (hereinafter referred to as "charging carrier") having an electrical conductivity and magnetism, which are forcedly magnetically held by a bearing member also serving as a feeder electrode. The magnetic brush charging member brings the magnetic brush into contact with the member to be charged and supplies an electricity to the bearing member.

More specifically, the charging carriers are forcedly magnetically held directly on a magnet or on a sleeve including a magnet therein as a magnetic brush, and the magnetic brush portion is brought into contact with the member to be charged while the magnetic brush charging member is stopped or rotated. Also, a voltage is applied to the charging member, to thereby charge the member to be charged.

The fur brush charging member includes a brush portion (fur brush portion) of electrically conductive fibers which is born on a bearing member that also serves as a feeder electrode, and brings the brush portion of the electrically conductive fibers into contact with the member to be charged to supply an electricity to the bearing member.

In the charging member, the charge property is deteriorated when its fibers fall due to a long-time use or a long-time leaving, and the charge uniformity is liable to be uneven due to the restriction of the brush diameter or the like. On the other hand, in the magnetic brush charging member, such a phenomenon does not occur, thereby being capable of conducting charging uniformly and stably.

The injection charge using the magnetic brush, as shown in a model diagram of FIG. 15, can be considered to be equivalent to a series circuit consisting of a resistor R and a capacitor C in an image forming apparatus where a magnetic brush made up of charging carriers 202 which is born on a charging sleeve 201 of a magnetic brush charging device is brought into contact with a photosensitive drum 200 to charge the photosensitive drum 200. In an ideal charging process where injection charge is conducted due to the charging carriers 202, the capacitor C is charged in a time where the surface of the photosensitive drum 200 is anywhere in contact with the charging carriers 202 ((the width of a charged nip portion N)×(the peripheral speed of the photosensitive drum 200)), and the surface potential of the photosensitive drum 200 becomes substantially equal to the supply voltage.

(C) Cleanerless System (Cleanerless Process)

In recent years, in the image forming apparatus of the transfer system, a cleanerless system has been put into practical use in which remaining transfer toner that remains on the photosensitive drum is once collected by the above magnetic brush charging device for the purposes of not producing waste toner from the viewpoints of downsizing and simplification of the apparatus or ecology.

The toner that has been once collected by the charging device is brought into contact with the charging carriers so that charges equal in polarity to the potential of the photosensitive member are given to the toner, and the toner is discharged to the surface of the photosensitive member from the brush of the charging carriers due to an electric field developed by a potential difference ΔV between the supply voltage and the surface potential of the photosensitive member. The toner discharged onto the photosensitive member is collected by the developing device again. The principle is shown in FIG. 16. The DC bias for development is set to be lower than the potential of the photosensitive member while the discharge of the toner is effected by the charging apparatus (charging device), and the toner discharged onto the photosensitive member due to the potential difference and the mechanical frictional force is collected to the developing apparatus (developing device).

However, the magnetic brush charging device using the above magnetic brush charging member suffers from a problem in that the charging carriers that form the magnetic brush may be stuck onto the surface of the image bearing member and flow out therefrom.

In particular, in case of the cleanerless system that collects the transfer remaining toner by the magnetic brush charging member (injection charger), the toner is mixed in the magnetic brush, and its electric resistance gradually increases. For that reason, the charges are not sufficiently moved while it passes through a charge nip, as a result of which the surface potential of the photosensitive member after the charges have passed through the charge nip becomes smaller than the supply voltage (the potential difference between the surface potential of the photosensitive member and the supply voltage is ΔV). In the case where no means for detecting the surface potential or no means for controlling the developing bias is provided, the drop of the potential of the photosensitive member induces the adhesion of the toner onto a non-image portion during development, that is, so-called fog. On the other hand, in the case where the AV is large, the charging carriers of the magnetic brush is stuck onto the surface of the photosensitive member and flow out from the magnetic brush portion to cause the failure of charging. Simultaneously, the flow-out charging carriers are liable to be collected by the developing device.

In the developing device using an inductance detecting type sensor, when the charging carriers on the magnetic brush charging device side are collected by the developing device, even if the charging carriers of the slight amount that causes no problem from the viewpoint of an image are stuck onto the surface of the photosensitive member, the charging carriers are stored within the developing device as the number of copies becomes large. As a result, in the case where the permeability is different between the charging carriers and the developing carriers of the two-component developer, the apparent permeability of the entire developer varies, whereby there may occur an error in the toner density control by the inductance detecting type sensor.

In other words, in the case where the permeability of the charging carriers are larger than that of the developing carriers, although the toner density of the developer within the developer container is kept constant, if the charging carriers are mixed with the developer, the inductance detecting sensor detects that the average permeability of the developer is large. Since this means that the ratio of the carrier particles to the developer within the constant volume becomes larger, and the toner density becomes lower, the replenishment of toner starts and the density is so controlled as to be higher than an appropriate toner density.

On the contrary, in the case where the permeability of the charging carriers are smaller than that of the developing carriers, if the charging carriers are mixed with the developer, the inductance detecting sensor detects that the average permeability of the developer is small. Since this means that the ratio of the carrier particles to the developer within the constant volume becomes smaller, and the toner density becomes higher, the replenishment of toner stops and the density is so controlled as to be lower than an appropriate toner density.

The former case induces a problem in that the image density becomes higher due to the over-replenishment of toner, a problem in that the amount of developer increases with an increase in the amount of toner and the developer is leaked from the developer container, or a problem in that the toner is scattered due to the lowered toner charge amount with an increase in the ratio of the toner to the developer. Also, the latter case induces a problem in that the image is deteriorated due to a reduction in the amount of toner in the developer, the density of image is thinned or the density of image is thinned due to an increase in the toner charge amount.

Also, there is the possibility in that the adverse influence of the above problems is increased particularly according to the image forming operation, that is, as the number of copies is increased.

In addition, according to the study by the present inventors, there has been found that the adhesion of the charging carriers onto the photosensitive drum is promoted more particularly as the density of image is high or as the image ratio is large. For example, the mixing amounts of the charging carriers with the developing device, for example, when the solid images of A4 size and 0%, 6%, 15% and 30% in the image ratio are formed in 50,000 sheets were about 5 g, 7 g, 10 g and 15 g, respectively. It is presumed that as the image ratio is large or the image density is high, the transfer remaining toner collected by the charging device increases, and as mentioned above, AV increases due to the resistor of the charging carriers, and the mixing amount increases. It is also presumed that the reason why the mixing amount is not simply proportional to the image ratio is that the physical adhesion of the charging carriers onto the photosensitive drum surface or the carrier scattering due to the centrifugal force during the image forming operation does not depend on the image ratio but becomes uniform (see FIG. 11). In other words, in the above case, it is presumed that the mixing amount 5 g of charging carriers when the image ratio is 0% is the unavoidable mixing amount of charging carriers due to the influence of the physical adhesion of the charging carriers onto the image bearing member or the influence of the carrier scattering which is caused when the image has been formed in 50,000 sheets.

SUMMARY OF THE INVENTION

An object of the present invention is to provide an image forming apparatus which is capable of forming an excellent image even if electrically conductive particles provided in charging means enter developing means.

Another object of the present invention is to reduce an error occurring in the toner density control of an inductance detecting sensor in a developing device as much as possible even if the charging carriers on the magnetic brush charging device side are mixed with the two-component developer on the developing device side in an image forming apparatus of the magnetic brush contact charging system, the two-component developing system, the transfer system or the cleanerless system.

Still another object of the present invention is to provide an image forming apparatus, comprising: an image bearing member for bearing a latent image; charging means for charging the image bearing member by bringing ears of electrically conductive particles into contact with the image bearing member; developing means for visualizing the latent image formed on the image bearing member as a toner image by using a developer containing toner and carrier after the image bearing member has been charged by the charging means, the permeability of the carriers being different from the permeability of the electrically conductive particles; density control means for controlling the density of the developer within the developing means, the density control means detecting the permeability of the developer, comparing a detected signal value based on the detected result with a reference value, and controlling the density of the developer on the basis of the comparison result; and reference value correcting means for correcting the reference value, the reference value correcting means estimating the amount of electrically conductive particles that enter within the developing means and correcting the reference value on the basis of the estimated result.

Yet still another object of the present invention is to provide an image forming apparatus, comprising: an image bearing member for bearing a latent image; charging means for charging the image bearing member by bringing ears of electrically conductive particles into contact with the image bearing member; developing means for visualizing the latent image formed on the image bearing member as a toner image by using a developer containing toner and carrier after the image bearing member has been charged by the charging means, the permeability of the carriers being different from the permeability of the electrically conductive particles; density control means for controlling the density of the developer within the developing means, the density control means detecting the permeability of the developer, comparing a difference between a detected signal value based on the detected result and a reference value with a threshold value, and controlling the density of the developer on the basis of the comparison result; and threshold value correcting means for correcting the threshold value, the threshold value correcting means estimating the amount of electrically conductive particles that enter within the developing means and correcting the threshold value on the basis of the estimated result.

Other objects and features of the present invention will become more clear from the following detailed description with reference to the accompanying drawings.

DESCRIPTION OF THE PREFERRED EMBODIMENTS (First Embodiment)

Figure 1:
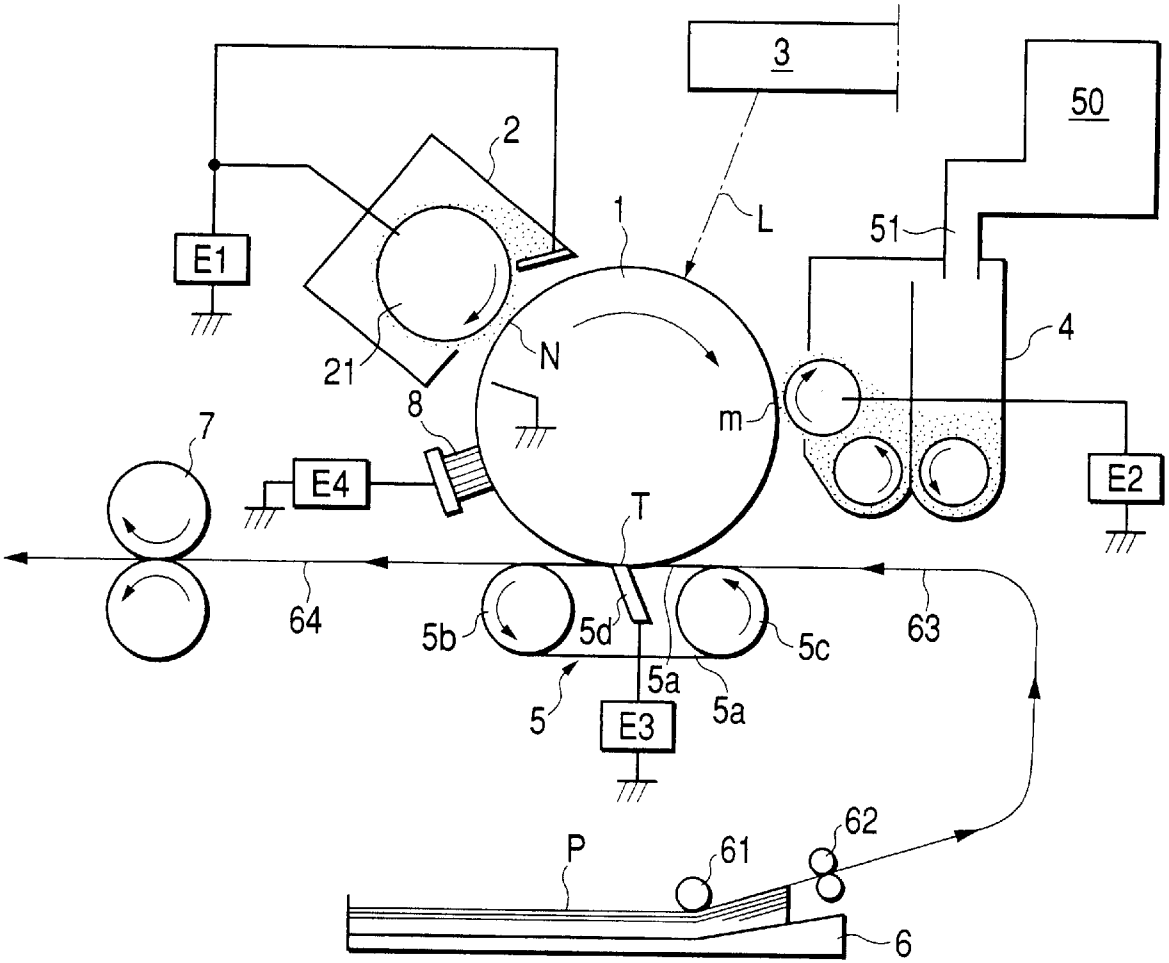
FIG. 1 is a schematic diagram showing the entire structure of an image forming apparatus in accordance with an embodiment of the present invention.

(1) An Example of Image Forming Apparatus (FIG. 1)

FIG. 1 is a schematic diagram showing the structure of an example of an image forming apparatus. The image forming apparatus according to this embodiment is directed to laser beam printers of the transfer electrophotographic process, the magnetic brush charging system, the two-component developing system and the cleanerless process.

Reference numeral 1 denotes an electrophotographic photosensitive member (photosensitive drum) of the rotating drum type as an image bearing member. The photosensitive drum 1 of this embodiment is directed to an OPC photosensitive member of the negative charge property and the charge injection charge property (organic photoconductive photosensitive member) which is rotationally driven at a process speed (peripheral velocity) of 150 mm/sec in a clockwise direction indicated by an arrow.

Reference numeral 2 denotes a magnetic brush charging device (charger) as a contact charging device that uniformly charges the surface of the photosensitive drum 1 to a desired polarity and potential. The surface of the rotating photosensitive drum 1 is uniformly charged to about −700 V by the magnetic brush charging device 2 due to the charge injection charging system.

Figure 8:
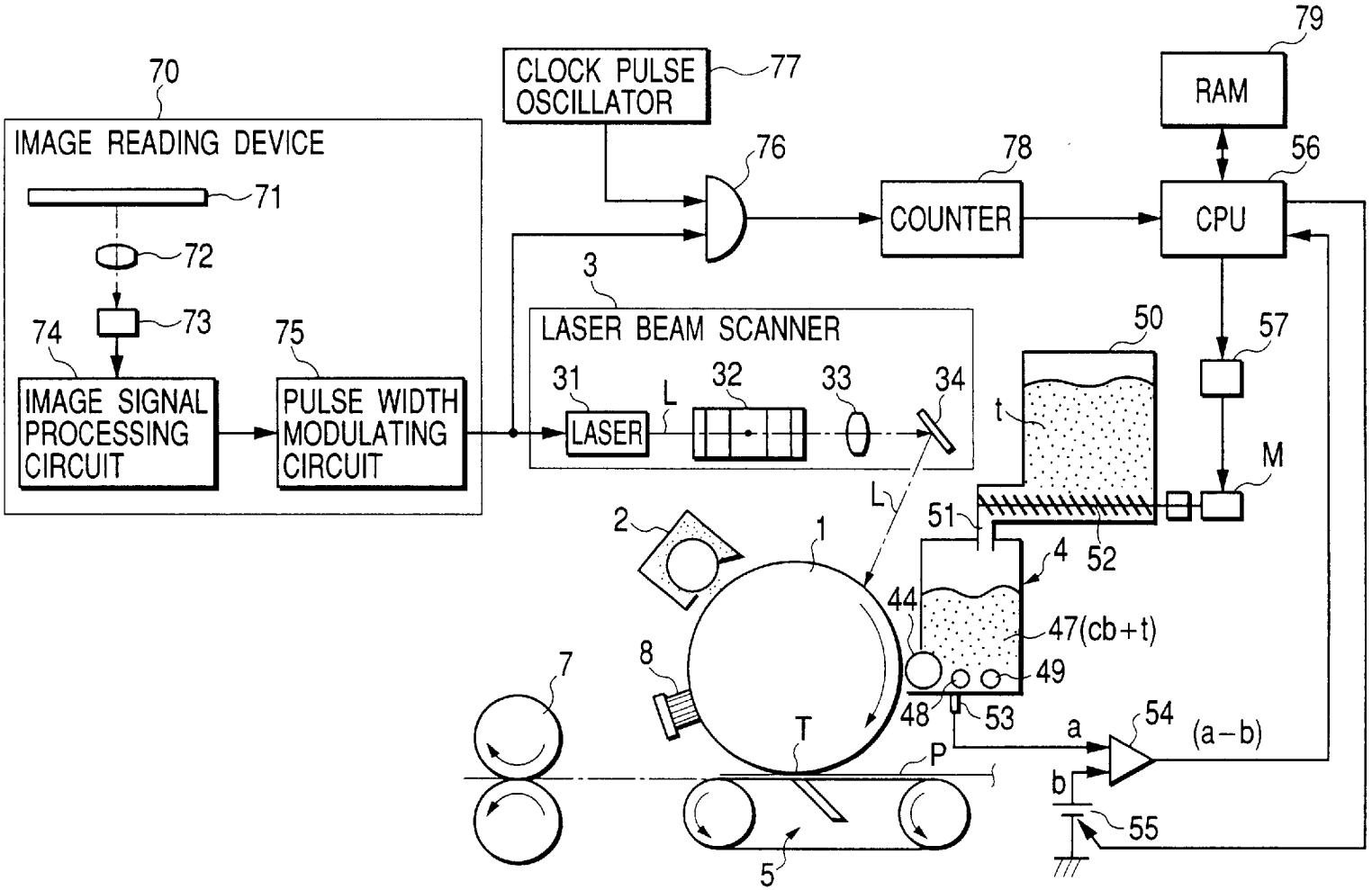
FIG. 8 is a block diagram showing a toner replenishment control system.

Reference numeral 3 denotes a laser beam scanner as image information writing means. The laser beam scanner 3 includes, as shown in FIG. 8, a semiconductor laser 31, a polygon mirror 32, an F-θ lens 33, a deflection mirror 34 and so on. The laser beam scanner 3 emits a laser beam L modulated in accordance with a time-series electric digital pixel signal of objective image information which is inputted from an original reading device 70 having a photoelectric conversion element 70 such as CCD or a not-shown host device such as an electronic calculator or a word processor, and scans and exposes the uniformly charged surface of the rotating photosensitive drum 1 by the laser beam. With the laser beam scanning exposure, an electrostatic latent image is formed on the peripheral surface of the rotating photosensitive drum 1 in accordance with the objective image information.

Reference numeral 4 denotes a developing apparatus (developing device) of the two-component contact developing system using a developer in which non-magnetic toner is mixed with magnetic carriers. The developing device 4 effects reversal developing of the electrostatic latent image on the surface of the rotating photosensitive drum 1 as a toner image.

Reference numeral 5 denotes a transfer device disposed on a lower side of the photosensitive drum 1, and the transfer device of this embodiment is of the transfer belt type. Reference numeral 5*a* denotes an endless transfer belt (for example, a belt of 75 μm in film thickness and made of polyimide). The endless transfer belt 5*a* is put on and between a driving roller 5*b* and a driven roller 5*c* and rotates at the peripheral velocity substantially equal to the rotating peripheral velocity of the photosensitive drum 1 in a forward rotating direction of the photosensitive drum 1. Reference numeral 5*d* denotes an electrically conductive blade disposed inside the transfer belt 51 and which presses the upper belt portion of the transfer belt 5*a* toward the lower surface portion of the photosensitive drum 1 to form a transfer nip portion T as a transfer member.

Reference numeral 6 denotes a sheet feed cassette which stacks and contains transfer materials P such as papers therein. One sheet of the transfer materials P stacked and contained in the sheet supply cassette 6 is separated and fed by driving a sheet feed roller 61, and then fed at the transfer nip portion T between the rotating photosensitive drum 1 and the transfer belt 5*a* of the transfer device 5 at a predetermined (given) control timing after passing through a sheet path 63 including a conveying roller 62 and so on.

The transfer material P fed to the transfer nip portion T is nipped and conveyed between the rotating photosensitive drum 1 and transfer belt 5*a*, during which a given transfer bias is applied to the electrically conductive blade 5*d* from the transfer bias supply power E3 to charge a back surface of the transfer material P with a reverse polarity of the toner. As a result, the toner image on the surface side of the rotating photosensitive drum 1 is sequentially electrostatically transferred onto a front surface side of the transfer material P that passes through the transfer nip portion T.

The transfer material P that passed through the transfer nip portion T and was subjected to the transfer of a toner image is sequentially separated from the rotating photosensitive drum 1 surface and introduced into a fixing device (for example, a heat roller fixing device) 7 through a sheet path 64. The transfer material P is then subjected to the fixing process of the toner image and printed out.

The printer of this embodiment conducts the cleanerless process and provides no special cleaner for removing the toner which is not transferred to the transfer material P but remains on the surface of the rotating photosensitive drum 1. The remaining transfer toner then passes through the position of the electrically conductive brush 8 which is in contact with the photosensitive drum 1 and reaches the position of the magnetic brush charging device 2 in association with the rotation of the photosensitive drum 1 and is temporarily collected in the magnetic brush portion of the magnetic brush charging member 21. The collected toner is again discharged to the photosensitive drum 1 surface and finally collected in the developing device 4 by cleaning simultaneous with developing, and the photosensitive drum 1 forms images repeatedly.

The electrically conductive brush 8 is so adapted as to electricity-erase or reversely charge the remaining transfer toner to improve the collecting coefficient by the magnetic brush charging member 21. An AC (a.c.) (alternating current) bias, a DC bias reverse in polarity to the charge or a DC bias reverse in polarity to the charge on which a AC is superimposed is applied to the electrically conductive brush 8 from a power supply E4.

The cleaning simultaneous with developing is directed to a method of collecting the transferred toner which slightly remains on the photosensitive member by a fog removal bias (a fog removal potential difference Vback which is a potential difference between the DC voltage applied to the developing means and the surface potential of the photosensitive member) in a succeeding developing process. According to this method, because the remaining transfer toner is collected by the developing means and used in the succeeding process, a waste toner can be eliminated and the troublesomeness of maintenance can be reduced. Also, the method is largely advantageous in the space because of cleanerless so as to remarkably downsize the image forming apparatus.

Figure 2:
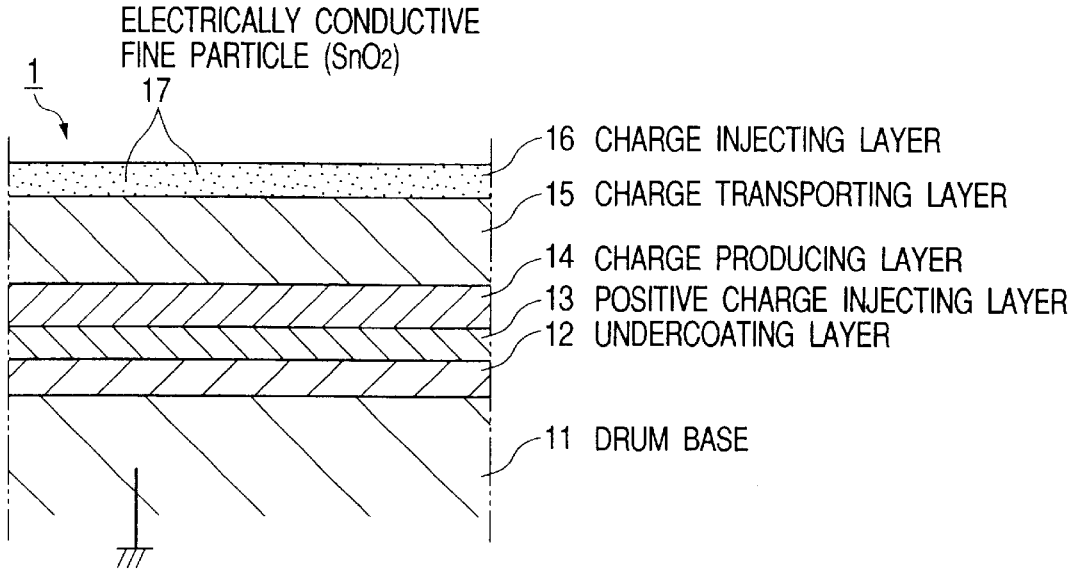
FIG. 2 is a schematic diagram showing the layer structure of a photosensitive member.

(2) Photosensitive Drum 1 (FIG. 2)

The photosensitive drum 1 of this embodiment is directed to an OPC photosensitive member of the negative charge property and the charge injection charge property as described above, and as shown in the schematic diagram of the layer structure of FIG. 2, first to fifth function layers 12 to 16 are disposed on a drum base 11 having a diameter of 30 mm (ϕ30 mm) and made of aluminum in the stated order from the lowest.

The first layer 12 is an undercoating layer formed of an electrically conductive layer about 20 μm in thickness which is disposed in order to level a defect of the aluminum drum base 11 and also in order to prevent the occurrence of moire caused by the reflection of a laser beam exposure.

The second layer 13 is a positive charge injecting preventing layer which prevents the positive charges injected from the aluminum drum base 11 from canceling the negative charges charged on the photosensitive member surface. The second layer 13 is directed to an intermediate resistant layer about 1 μm in thickness the resistance of which is adjusted to about 106 Qcm by amylene resin and methoxymethylnylon.

The third layer 14 is a charge producing layer which is about 0.3 μm in thickness where disazo pigment is dispersed in a resin and produces positive and negative charge pair upon receiving a laser exposure.

The fourth layer 15 is a charge transporting layer which is of a p-type semiconductor where hydrazone is dispersed in the polycarbonate resin. Accordingly, the negative charges charged on the photosensitive member surface cannot be moved to that layer, and only the positive charges produced in the charge producing layer 14 can be transported to the photoelectric member surface.

The fifth layer 16 is a charge injecting layer that is directed to a coating layer about 3 μm in thickness which is made of a material where 70 weight % of the fine particles 17 of tin oxide ($SnO_2$) of 0.03 μm in grain diameter whose resistance is lowered (made electrically conductive) by doping the optically curing acrylic resin as binder with antimony as an electrically conductive filler is dispersed in the resin. The electric resistance of the charge injecting layer 16 needs to be $1\times10^{10}$ to $1\times10^{14}$ Ωcm which is the condition in which the charge property is sufficient and image flow does not occur. In this embodiment, the photosensitive drum the surface resistance of which is $1\times10^{11}$ Ωcm is employed.

Figure 3:
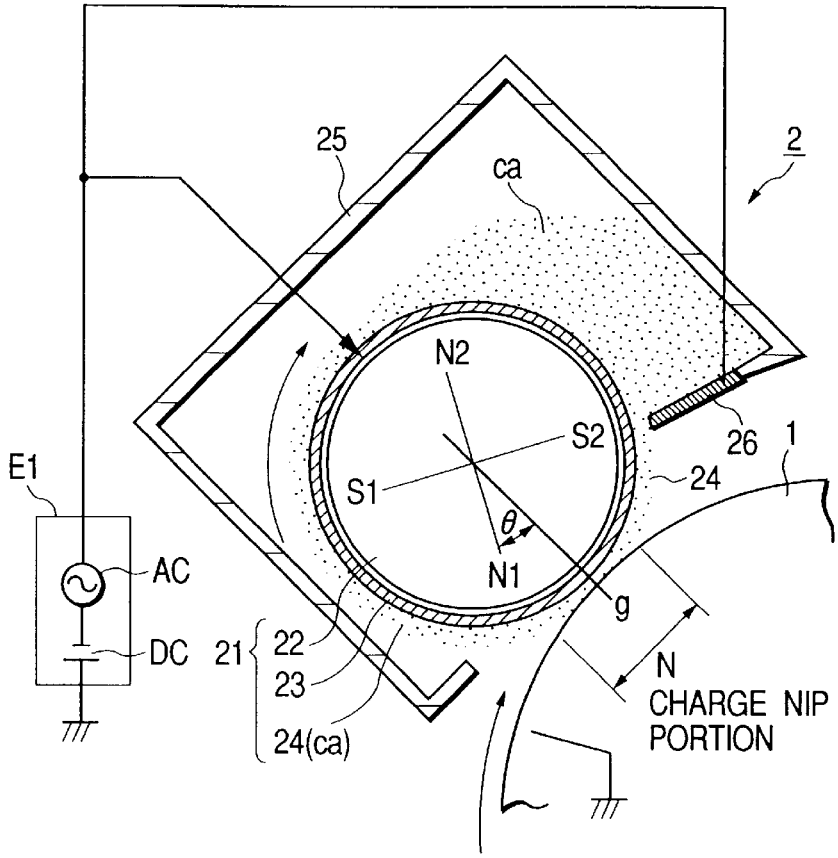
FIG. 3 is a schematic diagram showing the structure of a magnetic brush charging device.

(3) Magnetic Brush Charging Device 2 (FIG. 3)

FIG. 3 is an enlarged transverse view of the magnetic brush charging device 2. The magnetic brush charging device 2 of this embodiment is roughly made up of a magnetic brush charging member 21, a container (housing)

25 which contains the magnetic brush charging member 21 and the charging carriers (charging magnetic carriers) ca therein, a magnetic brush layer thickness regulating blade 26, a charging bias supply source El for the magnetic brush charging member 21, and so on.

The magnetic brush charging member 21 of this embodiment is of the sleeve rotating type which includes a magnet roll (magnet) 22, a non-magnetic stainless sleeve (called "electrode sleeve", "electrically conductive sleeve", "charging sleeve", or the like) 23 which surrounds the magnetic roll 22, and a magnetic brush portion 24 of charging carriers ca magnetically forcedly held on the outer peripheral surface of the sleeve 23 by the magnetic force of the magnet roll 22 inside the sleeve 23.

The magnet roll 22 is formed of a non-rotating fixed member, and the sleeve 23 rotationally drives the outer periphery of the magnet roll 22 by a not-shown drive system at a given peripheral velocity, in this embodiment, at the peripheral velocity of 225 mm/sec in a clockwise direction indicated by an arrow. Also, the sleeve 23 is opposed to the photosensitive drum 1 with a gap of about 500 $\mu$m therebetween by means such as a spacer roller.

The magnetic brush layer thickness regulating blade 26 is formed of a non-magnetic stainless blade attached to the container 25, and the regulating blade 26 is so disposed as to provide a gap of 900 $\mu$m with respect to the sleeve 23 surface.

The charging carrier ca within the container 25 is partially magnetically forcedly held on the outer peripheral surface of the sleeve 23 by the magnetic force of the magnet roll 22 within the sleeve as a magnetic brush portion 24. The magnetic brush portion 24 rotates in the same direction of that of the sleeve 23 together with the sleeve 23, with the rotational drive of the sleeve 23. In this situation, the thickness of the magnetic brush portion 24 is regulated uniformly by the blade 26. Then, since the regulated thickness of the magnetic brush portion 24 is larger than an interval of the gap portion opposed between the sleeve 23 and the photosensitive drum 1, the magnetic brush portion 24 forms a nip portion of a given width with respect to the photosensitive drum 1 and is in contact with the photosensitive drum 1 in the opposed portion of the sleeve 23 and the photosensitive drum 1. The contact nip portion is directed to a charge nip portion N. Accordingly, the rotating photosensitive drum 1 is frictionally slid by the magnetic brush portion 24 that rotates with the rotation of the sleeve 23 of the magnetic brush charging member 21 in the charge nip portion N. In this case, in the charge nip portion N, the moving direction of the photosensitive drum 1 is opposite to the moving direction of the magnetic brush portion 24, and the relative moving speed becomes high.

A given charge bias is applied to the sleeve 23 and the magnetic brush layer thickness regulating blade 26 from the power supply E1.

Thus, the photosensitive drum 1 is rotationally driven, the sleeve 23 of the magnetic brush charging member 21 is rotationally driven and a given charge bias is applied from the power supply E1 so that the peripheral surface of the rotating photosensitive drum 1 is uniformly contact-charged to a given polarity and potential by the charge injection charging system in case of this embodiment.

The magnet roll 22 fixedly disposed within the sleeve 23 has a magnet pole (main pole) N1 of about 900 G ($900\times10^{-4}$ T) at a position of 10° upstream of the photosensitive drum rotating direction from the closest position g of the sleeve 23 and the photosensitive drum 1.

The main pole N1 desirably sets the angle θ with respect to the closest position g of the sleeve 23 and the photosensitive drum 1 to fall within a range of 20° (π/9 rad) upstream of the photosensitive drum rotating direction to 10° (π/18 rad) downstream thereof, and the main pole N1 is more preferably disposed at 150 (15π/180 rad) to 0° (0 rad) of the upstream side. If the main pole N1 is lower than that range, the charging carrier ca is attracted to the main pole N1 position, and the residence of the charging carrier ca is liable to occur downstream of the photosensitive drum rotating direction with respect to the charge nip portion N. Also, if the main pole N1 is disposed extremely upstream, the transportability of the charging carriers ca that has passed through the charge nip portion N is deteriorated, and the residence is liable to occur.

Also, in the case where no magnetic pole exists in the charge nip portion N, it is apparent that the binding force exerted on the sleeve 23 from the charge carriers ca is weakened, and the charging carriers ca are liable to be stuck onto the photosensitive drum 1.

The charge nip portion N described here represents a region where the charging carriers ca of the magnetic brush portion 24 are in contact with the photosensitive drum 1 during charging.

The charge bias is applied to the sleeve 23 and the regulating blade 26 by the power supply E1. In this embodiment, a bias where an a.c. component is superimposed on a d.c. component is used.

The charges are supplied onto the photosensitive drum 1 from the charging carriers ca that constitutes the magnetic brush portion 24 by the sliding friction of the magnetic brush charging member 21 on the photosensitive drum 1 surface due to the magnetic brush portion 24 in the charge nip portion N and by the application of the charge bias to the magnetic brush charging member 21 therein, and the photosensitive drum 1 surface is uniformly contact-charged to a given polarity and potential. In this embodiment, since the photosensitive drum 1 has the charge injecting layer 16 on its surface as described above, the photosensitive drum 1 is charged due to the charge injection charging. In other words, the photosensitive drum 1 surface is charged to a potential corresponding to the d.c. component of the charge bias d.c.+a.c. The sleeve 23 has the tendency that the charge uniformity becomes more excellent as the rotating speed is high.

In the charge bias d.c.+a.c., the d.c. component is equal to the required surface potential of the photosensitive drum 1, and in this embodiment, −700 V.

In the a.c. component during an image forming process (image forming time), a peak-to-peak voltage Vpp is set to be 100 V or more but 2000 V or less, particularly the voltage Vpp is preferably set to 300 V or more but 1200 V or less. If the peak-to-peak voltage Vpp is less than that value, the improvement of the charge uniformity and the rising property of the potential is low, and if the peak-to-peak voltage Vpp is more than that value, the residence of the charging carriers ca and the adhesion of the charging carriers onto the photosensitive drum are deteriorated.

The frequency is set to be 100 Hz or higher but 5000 Hz or lower, in particular, preferably 500 Hz or higher but 2000 Hz or lower. If the frequency is lower than that lower limit, the adhesion of the charging carriers ca to the photosensitive drum is deteriorated, and the improvement of the charge uniformity and the rising property of the potential is lowered. Even if the frequency is higher than that upper limit, the improvement of the charge uniformity and the rising property of the potential is difficult to obtain.

The waveform of the a.c. component may be of a rectangular wave, a triangular wave, a sine wave and so on.

As the charging carriers ca that constitute the magnetic brush portion 24, sintered ferromagnetic substance (ferrite) which has been reduced is employed in this embodiment. As the other materials, a resin and ferromagnetic powders which are agitated and shaped in particles, those particles which are mixed with electrically conductive carbon or the like in order to adjust the resistance, or those particles which are subjected to a surface treatment can be employed likewise.

The charging carriers ca of the magnetic brush portion 24 must be adapted to excellently inject charges to the trap level of the photosensitive drum surface and prevent electricity destroy of the charging member and the photosensitive drum which is caused by concentrating the charge current in a defect such as a pin hole produced on the photosensitive drum.

Accordingly, the resistance of the magnetic brush charging member 21 is preferably set to $1\times10^4$ Ω to $1\times10^9$ Ω, and in particular more preferably to $1\times10^4$ Ω to $1\times10^7$ Ω. If the resistance of the magnetic brush charging member 21 is less than $1\times10^4$ Ω, a pin hole leak tends to be liable to occur, and if the resistance of the magnetic brush charging member 21 exceeds $1\times10^9$ Ω, an excellent charge injection tends to be difficult. Also, in order to control the resistance within the above range, it is preferable that the volume resistance of the charging carriers ca is set to $1\times10^4$ Ωcm to $1\times10^9$ Ωcm, and in particular more preferably to $1\times10^4$ Ωcm to $1\times10^7$ Ωcm.

Figure 4:
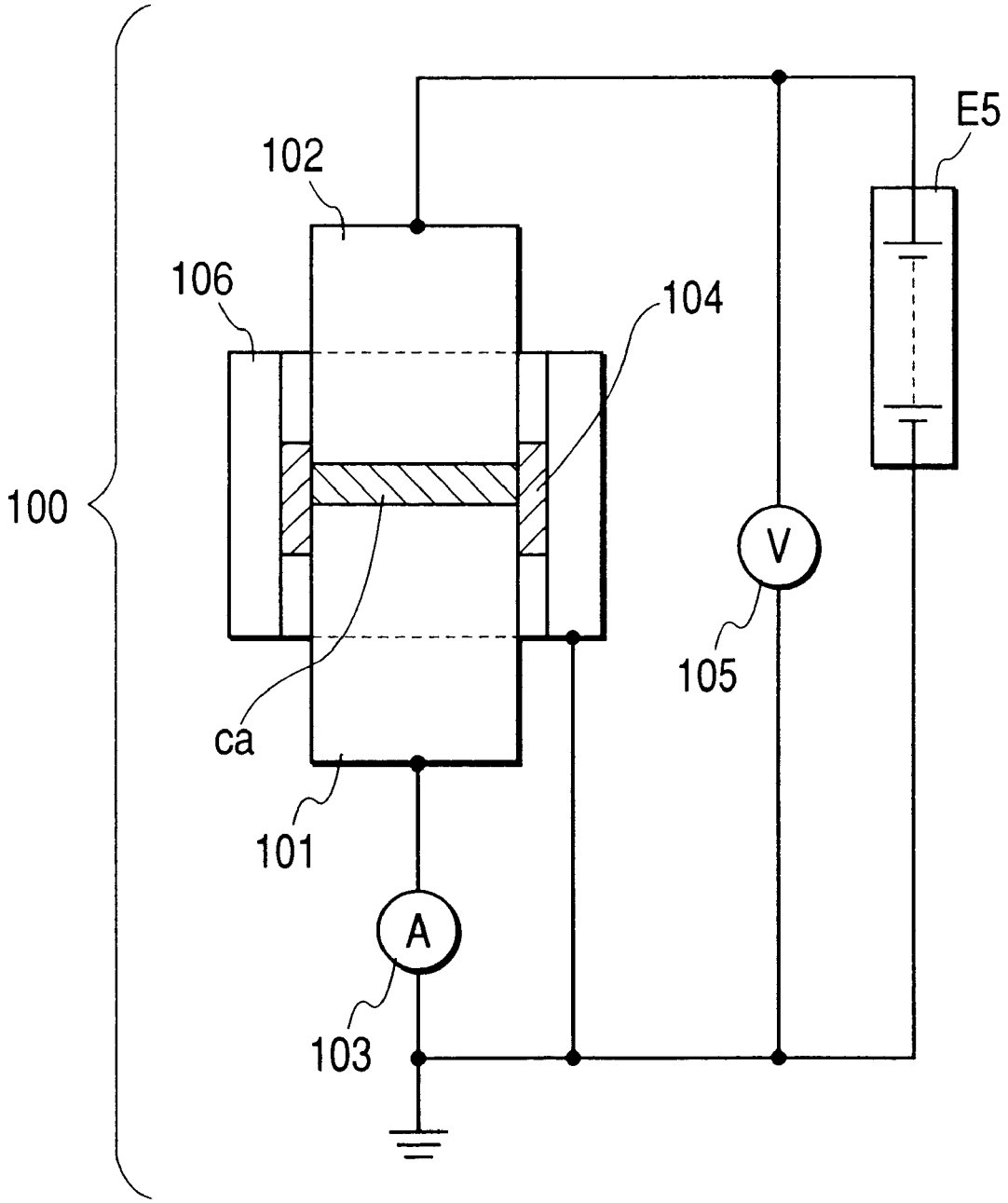
FIG. 4 is a schematic diagram showing the structure of a measuring device for the electric resistance of magnetic particles.

The volume resistance of the charging carriers ca was measured in a manner shown in FIG. 4. That is, a cell 100 is filled with charging carriers ca, and a main electrode 101 and an upper electrode 102 are so disposed as to be in contact with the filled charging carriers ca. A voltage is applied between the electrodes 101 and 102 from a constant voltage power supply E5, and a current which flows in this situation is measured by an ammeter 103 to obtain the volume resistance. Reference numeral 104 denotes an insulating material, 105 is a voltmeter, and 106 is a guide ring.

The measuring conditions are that the contact area S of the filled charging carriers ca with the cell is 2 $cm^2$, the thickness d is 1 mm, the weight of the upper electrode 102 is 10 kg and the supply voltage is 100 V under the environments of temperature 23° C. and humidity 65%.

It is preferable that the peak in the measurement of the average grain diameter and viscosity distribution of the charging carriers ca is within 5 to 100 μm from the viewpoint of preventing the charge from being deteriorated due to the contamination of the particle surface. The average grain diameter of the charging carriers ca is exhibited by a horizontal maximum length, and in the measuring method, the magnetic particles of 300 or more are selected at random through the microscope method, and their diameters are measured to take the calculated average.

The permeability of the charging carriers ca used in this embodiment is 270 emu/$cM^3$ ($270\times4\pi\times10^{-4}1.08\pi\times10^{-1}$ $Wb/m^2$) and the resistance of the magnetic brush charging member 21 is $1\times10^6$ Ωcm. A voltage −700 V is applied as the d.c. component of the charge bias so that the surface potential of the photosensitive drum 1 becomes also −700 V.

Figure 5:
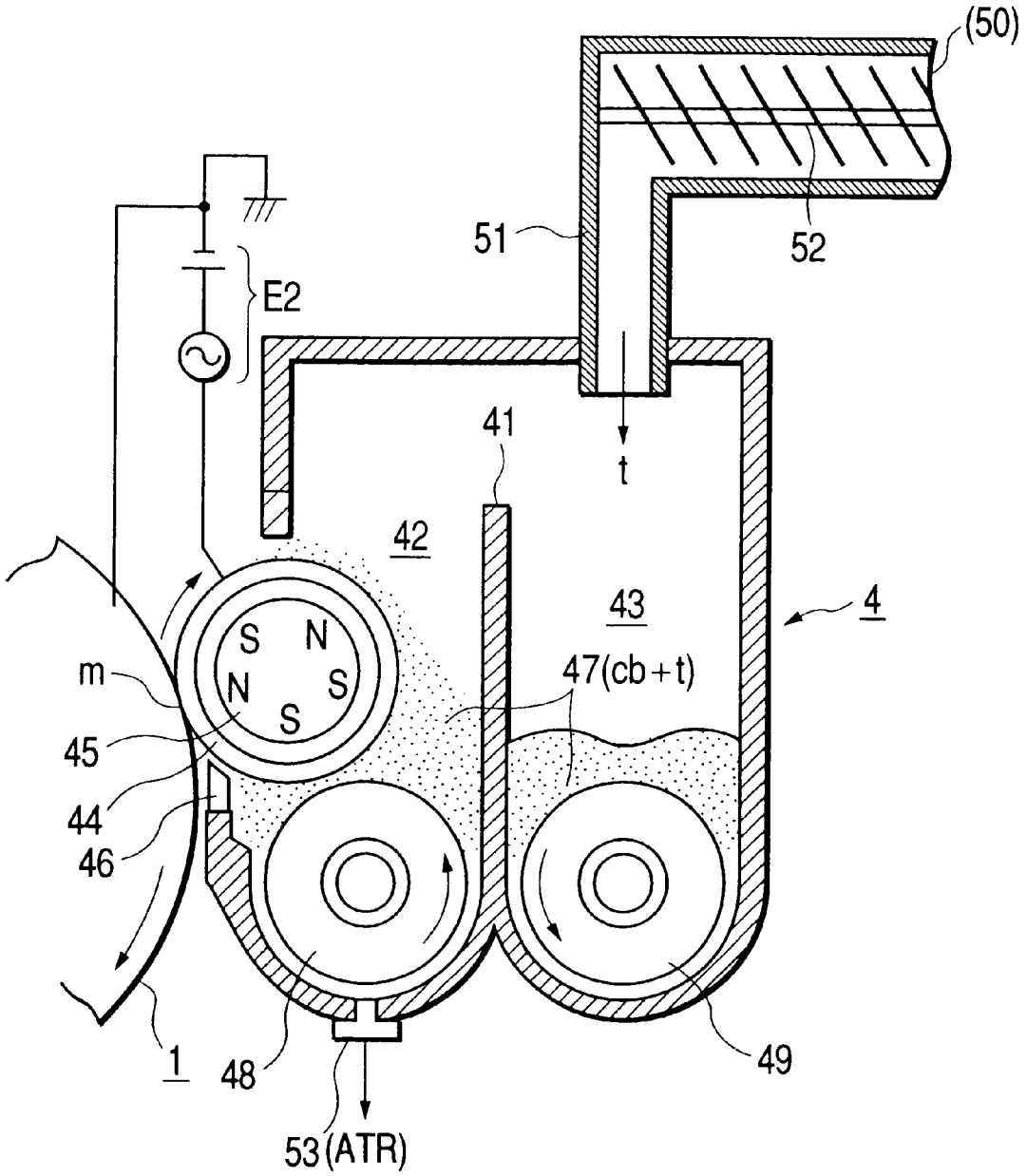
FIG. 5 is a schematic diagram showing the structure of a two-component developing device.

(4) Developing Device 4 (FIG. 5)

FIG. 5 is an enlarged schematic diagram of the developing device 4. The developing device 4 is opposed to the photosensitive drum 1, and its interior is sectioned into a first chamber (developing chamber) and a second chamber (agitating chamber) 43 by a partition 41 that extends perpendicularly.

In the first chamber 42, a non-magnetic developing sleeve 44 that rotates in a clockwise direction indicated by an arrow is disposed as the developer bearing member, and a magnet 45 is fixedly disposed within the developing sleeve 44.

The developing sleeve 44 bears and carries a layer of a two-component developer 47 including developing carriers (magnetic developing carriers) cb and non-magnetic toner t which is regulated in thickness by a blade 46, and supplies the developer to the photosensitive drum 1 in a developing region m which is opposed to the photosensitive drum 1, to thereby develop the electrostatic latent image as a toner image. A reversal development is conducted in this embodiment.

In order to improve the developing coefficient, that is, the ratio of giving the toner to the latent image, a developing bias voltage where a d.c. voltage DC is superimposed on an a.c. voltage AC is applied to the developing sleeve 44 from a power supply E2.

Developer agitating screws 48 and 49 are disposed in the first chamber 42 and the second chamber 43, respectively. The screw 48 agitates and carries the two-component developer 47 (cb+t) in the first chamber 42, and the screw 49 agitates and carries the toner t supplied from a toner exhaust port 51 of a toner replenishment tank 50 (FIG. 1), which will be described later, by the rotation of a carrying screw 52 and the developer 47 which has already been in the developing device to uniform the density of toner.

A developer passage (not shown) which mutually communicates the first chamber 42 and the second chamber 44 is formed in the partition 41 at a front end portion and a back end portion of FIG. 5. Due to the carrying force of the screws 48 and 49, the developer 47 within the first chamber 42 in which the toner is consumed by developing and the density of toner is lowered is moved from one passage into the second chamber 43, and the developer 47 within the second chamber 43 in which the density of toner is recovered is moved from the other passage into the first chamber 42.

In this embodiment, in order to correct a change in the developer density (toner density) within the developing device by the development of the electrostatic latent image, that is, in order to control the amount of toner replenished to the developing device 4, there is provided an inductance detecting system ATR in which an inductance head (inductance detecting sensor) 53 is disposed on a bottom wall of the first chamber (developing chamber) 42 of the developing device 4. The density of toner of the developer 47 within the developing device 4, more particularly, the actual toner density of the developer 47 within the first chamber 42 is detected in response to a detected signal from the inductance head 53 and compared with a reference value to replenish the toner.

a) Two-Component Developer 47

1) Toner Particles t:

The toner particles are not particularly limited. For example, the toner particles are made of spherical polymer toner, and in the toner manufacturing method, a monomer compound where a coloring agent and a charge control agent are added to the polymerization monomer is suspended in a water medium and polymerized to obtain the toner particles. This method is preferred in manufacturing the spherical toner inexpensively. Also, the toner manufactured by the grinding method which has been frequently used up to now may be employed.

2) Developing Carriers cb:

The low-magnetic carriers are used as the developing carriers and combined with the above spherical polymerization toner t to achieve a high quality.

According to the present inventors' experiment, it is assumed that a distance (hereinafter referred to as "S-Dgap")

between the developer bearing member (developing sleeve 44) and the image bearing member (photosensitive drum 1) is set to 300 to 1000 $\mu$m, the amount of developer (hereinafter referred to as "M/S") on the developer bearing member per unit area is set to 20 to 50 mg/cm$^2$, and the mixing amount ratio of the toner t and the developing carriers (T/D ratio) is set to 5 to 12%. In this case, the strength of magnetization of the developing carriers cb is that if the strength ($\sigma$1000) of magnetization in a magnetic field of 1 kOe (1000 Oersteds) ($10^6/4\pi$ A/m) is 200 emu/cm$^3$ ($800\pi\times10^{-4}$ Wb/m$^2$) or less, preferably 140 emu/cm$^3$ ($560\pi\times10^{-4}$ Wb/m$^2$) or less, the mutual magnetic action of the adjacent magnetic brushes is small because of the low magnetization amount. As a result, since the ear of the magnetic brush becomes fine and short, the magnetic brush softly sweeps the toner stuck surface on the latent image, to thereby prevent the developing toner from being scraped off, that is, so-called scavenging. Thus, the image high in resolution can be provided. In this embodiment, the strength ($\sigma$1000) of magnetization of the developing carriers cb is 135 emu/cm$^3$ ($540\pi\times10^{-4}$ Wb/m$^2$).

The above-described magnetization characteristic was measured by using the vibration magnetic field type automatic magnetic characteristic recording device BHV-30 made by Riken Denshi Kabushiki Kaisha. The magnetic characteristic value of the carrier fine particles develops the external magnetic field of 1 kOe, and the strength of magnetization in this situation is obtained. The carriers are produced in a packing state where the carriers are sufficiently tightly enclosed in a cylindrical plastic container. In this state, the magnetization moment is measured, and the actual weight when a sample is inserted in the plastic container is measured to obtain the strength of magnetization (emu/g)(Wb·m/kg). Then, the true specific gravity of the carrier particles is obtained by an automatic dry type densimeter Acupic 1330 (made by Shimadzu Corporation), and the strength of magnetization (emu/g) is multiplied by the true specific gravity to obtain the strength of magnetization per unit volume (emu/cm$^3$)(Wb/m$^2$).

The charging carriers ca of the magnetic brush charging device and the developing carriers cb of the two-component developing device which are used in this embodiment are made of soft magnetic substance, and the strength of magnetization linearly increases together with an increase in the magnetic field in the magnetic field of up to about 1 kOe.

Figure 6:
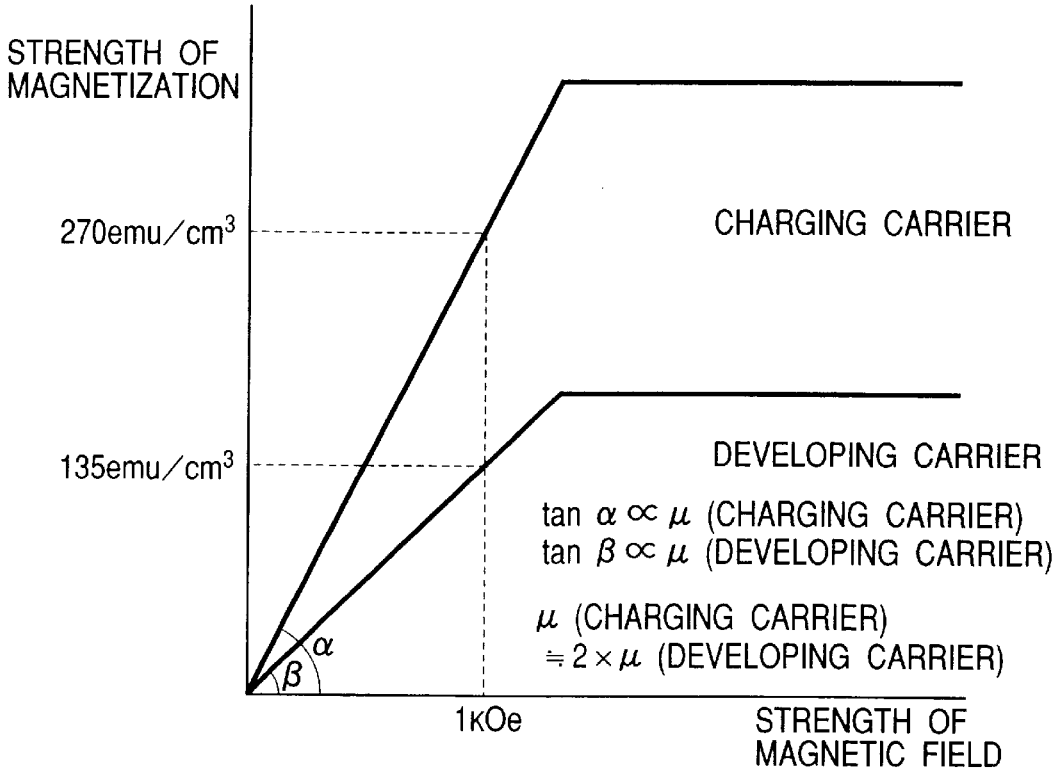
FIG. 6 is a graph for explaining a difference in permeability between charging carriers and developing carriers.

Therefore, the permeability is proportional to inclinations of tan $\alpha$ and tan $\beta$ shown in FIG. 6. Since the strength ($\sigma$1000) of magnetization of the charging carriers is substantially twice as compared with the developing carriers cb, the permeability is also twice. From this fact, in the case where the magnetic carriers are different in the permeability even if the toner density is identical, it is found that the detected output signal of the inductance detecting sensor is different.

b) Inductance Detecting System ATR

As described above, the two-component developer 47 mainly contains the magnetic developing carriers cb and the non-magnetic toner t, and if the toner density of the developer 47 (the ratio of the toner particle weight to the total weight of the developing carrier particles and the toner particles) varies, the apparent permeability caused by the developing carriers cb and the toner t varies.

Figure 7:
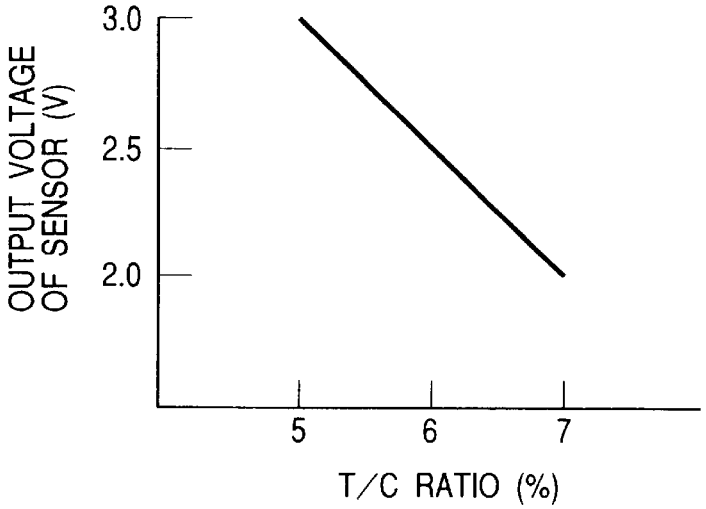
FIG. 7 is a characteristic graph showing a state in which a detected signal from an inductance head varies according to a change in the toner density of a developer.

When the apparent permeability is detected by the inductance head 53 and converted into an electric signal, the electric signal varies substantially linearly in accordance with the density of toner as shown in FIG. 7. In other words, the output electric signal from the inductance head 53 corresponds to the actual toner density of the two-component developer 47 within the developing device.

The processing of the output electric signal from the inductance head 53 will be described with reference to FIG. 8.

The output electric signal from the inductance head 53 is supplied to one input of a comparator 54. The other input of the comparator 54 is inputted with a reference electric signal corresponding to the apparent permeability in the normal toner density (the toner density in the initial set value) of the developer 47 by a reference electric signal source 55. Accordingly, since the comparator 54 compares the normal toner density with the actual toner density within the developing device, the detected signal of the comparator 54 is supplied to a CPU 56 as a result of comparing both the input signals.

The CPU 56 conducts control such that a succeeding toner replenishing time is corrected on the basis of the detected signal from the comparator 54.

For example, in the case where the actual toner density of the developer 47 which is detected by the inductance head 53 is smaller than the normal value, that is, in the case where the replenishment of toner is short, the CPU 56 operates the carrying screw 52 in the toner replenishment tank 50 so that the toner of the short amount is replenished to the developing device 4. That is, the CPU 56 calculates the screw rotating period of time required to replenish the toner of the short amount to the developing device 4 on the basis of the detected signal from the comparator 54, controls a motor drive circuit 57 to rotationally drive a motor M by the calculated period of time, and replenishes the toner of the short amount to the developing device 4.

Also, in the case where the actual toner density of the developer 47 which is detected by the inductance head 53 is larger than the normal value, that is, in the case where the replenishment of toner is excessive, the CPU 56 calculates the toner of the excessive amount in the developer on the basis of the detected signal from the comparator 54. Then, in forming an image on an original, the CPU 56 replenishes the toner so that the toner of the excessive amount is eliminated or forms an image without replenishing the toner until the toner of the excessive amount is consumed, that is, consumes the toner of the excessive amount by forming an image in a state where the toner is not replenished and conducts the toner replenishing operation in the above-described manner after the toner of the excessive amount is consumed, under control.

Subsequently, the operation of the above inductance detecting system ATR will be further described with reference to a flowchart shown in FIG. 9.

When the image forming apparatus starts in a block (step) S501, the toner density detection starts in a block S502.

A detected voltage signal a from the inductance head 53 is inputted to the comparator 54 in a block S503, the detected voltage signal a is compared with a reference voltage signal b from a reference voltage signal source 55 by the comparator 54, and its detected signal difference (a−b) is transmitted to the CPU 56 in a block S505.

It is judged in a block S506 whether (a−b)>0 is satisfied, or not, and if the toner density is lower than the reference value (YES), the toner replenishing period of time is determined in a block S507.

After the copying operation starts in a block S508, the toner is replenished between images for the toner replenishing period of time, which is determined in the block S507, in a block S509, and the operation is returned to start.

Also, if the toner density is higher than the reference value in the block S506 (NO), the copying operation of the block S510 starts, and the operation is returned to start without the replenishment of toner.

The timing of the toner density detection may be immediately before the copying operation restarts or during the copying operation. For example, the first toner density detecting operation may be made immediately before the copying operation restarts, and the subsequent toner density detecting operation may be made during the copying operation.

Also, in the inductance detecting system ATR used in this embodiment, the reference value of the detected signal in the optimum toner density (The reference value is 6% in this embodiment. There may occur problems in that if the reference value is too higher than 6%, the toner is dispersed whereas if it is too lower than 6%, the image density is low.) is adjusted to be 2.5 V. If the detected signal of the sensor 53 is larger than the reference value (for example, 3.0 V), the toner is replenished whereas if the detected signal of the sensor 53 is smaller than the reference value (for example, 2.0 V), the replenishment of the toner stops. It is needless to say that the present invention is not limited to the above signal processing, and the circuit structure may be changed so that the reference value is changed to a value other than 2.5 V. Also, if the toner density is lower than the optimum value, the detected signal of the sensor 53 may be set to be smaller than the reference value of the sensor 53, and if the toner density is higher than the optimum value, the detected signal of the sensor 53 may be set to be larger than the reference value of the sensor 53.

c) Detected Signal Reference Value Correcting Means

In the above-mentioned structure, as was already described above, as the problem of the magnetic brush charging device 2, the adhesion and flow-out of the charging carriers ca that constitutes the magnetic brush portion 24 of the magnetic brush charging member 21 onto the photosensitive drum 1 surface may occur. If the adhered or flow-out charging carriers are collected in the two-component developing device 4, in the developing device 4 using the inductance detecting system sensor 53, even if the charging carriers of the slight amount which causes no specific problem on the image is stuck onto the photosensitive drum 1 surface, the apparent permeability of the entire developer varies in the case where the developing carriers cb and the charging carriers ca are different in permeability, since the collected charging carriers ca are more stored in the developing device 4 as the number of copies increases. As a result, there may occur an error in the toner density control due to the inductance detecting system sensor 53.

Figure 10A:
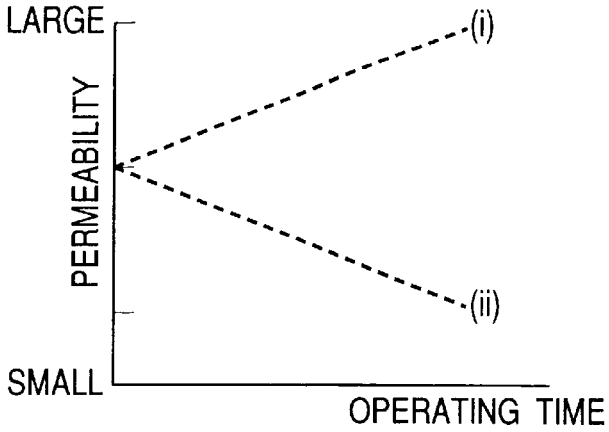
FIGS. 10A, 10B and 10C are graphs simply showing the relationship of a change in the apparent permeability of a developer, a detected signal of an inductance detecting sensor and the T/D ratio of the developer, in the case where the charging carriers are mixed with the developer and stored therein.
Figure 10B:
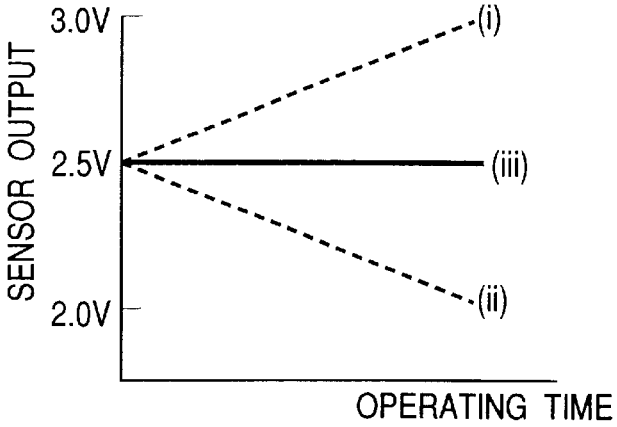

For example, as shown in FIG. 10B, when the optimum toner density of the developer is 6%, the initial value of the detected signal from the inductance head 53 is set to 2.5 V. However, when the charging carriers ca are phasedly stored as the image forming operation is repeated, if the permeability of the charging carriers ca is larger than the permeability of the developing carriers cb, the apparent permeability of the developer 47 phasedly increases as indicated by a dotted line (i) of FIG. 10A. On the other hand, if the permeability of the charging carriers ca is smaller than the permeability of the developing carriers cb, the apparent permeability of the developer 47 phasedly decreases as indicated by a dotted line (ii) of FIG. 10A.

Accordingly, when the toner density is controlled to the initial value, that is, 6%, if the permeability of the charging carriers ca is larger than the permeability of the developing carriers cb, its output phasedly increases as indicated by a dotted line (i) of FIG. 10B, whereas if the permeability of the charging carriers ca is smaller than the permeability of the developing carriers cb, its output gradually decreases as indicated by a dotted line (ii) of FIG. 10B.

Figure 10C:
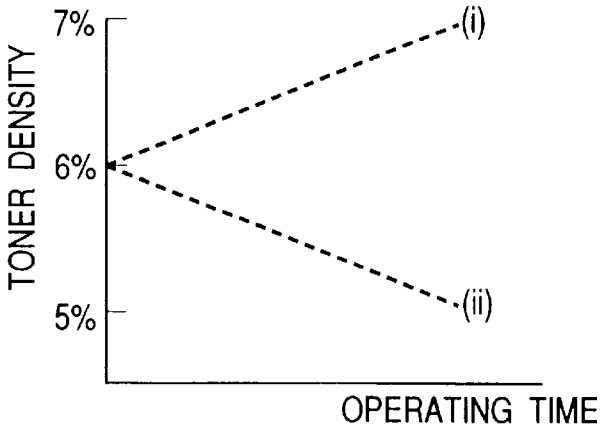

However, as a result that, in fact, the toner is replenished ((iii) of FIG. 10B) so that the detected signal from the inductance detecting sensor 53 becomes the initial reference value 2.5 V, if the permeability of the charging carriers ca is larger than the permeability of the developing carriers cb as shown in FIG. 10C, the toner density gradually increases as indicated by a dotted line (i) of FIG. 10C. On the other hand, if the permeability of the charging carriers ca is smaller than the permeability of the developing carriers cb as shown in FIG. 10C, the toner density phasedly decreases as indicated by a dotted line (ii) of FIG. 10C.

The above description is given of the respective phenomenons in the cases where the permeability of the charging carriers ca is larger and smaller than the permeability of the developing carriers cb. The following description will be given in more detail of a case in which the permeability of the charging carriers ca is larger than the permeability of the developing carriers cb (about twice) as employed in this embodiment. It should be noted that the present invention is not limited to the case in which the permeability of the charging carriers ca is larger than the permeability of the developing carriers cb. The present invention is applicable if the permeabilities of both the charging and developing carriers are different.

Figure 11:
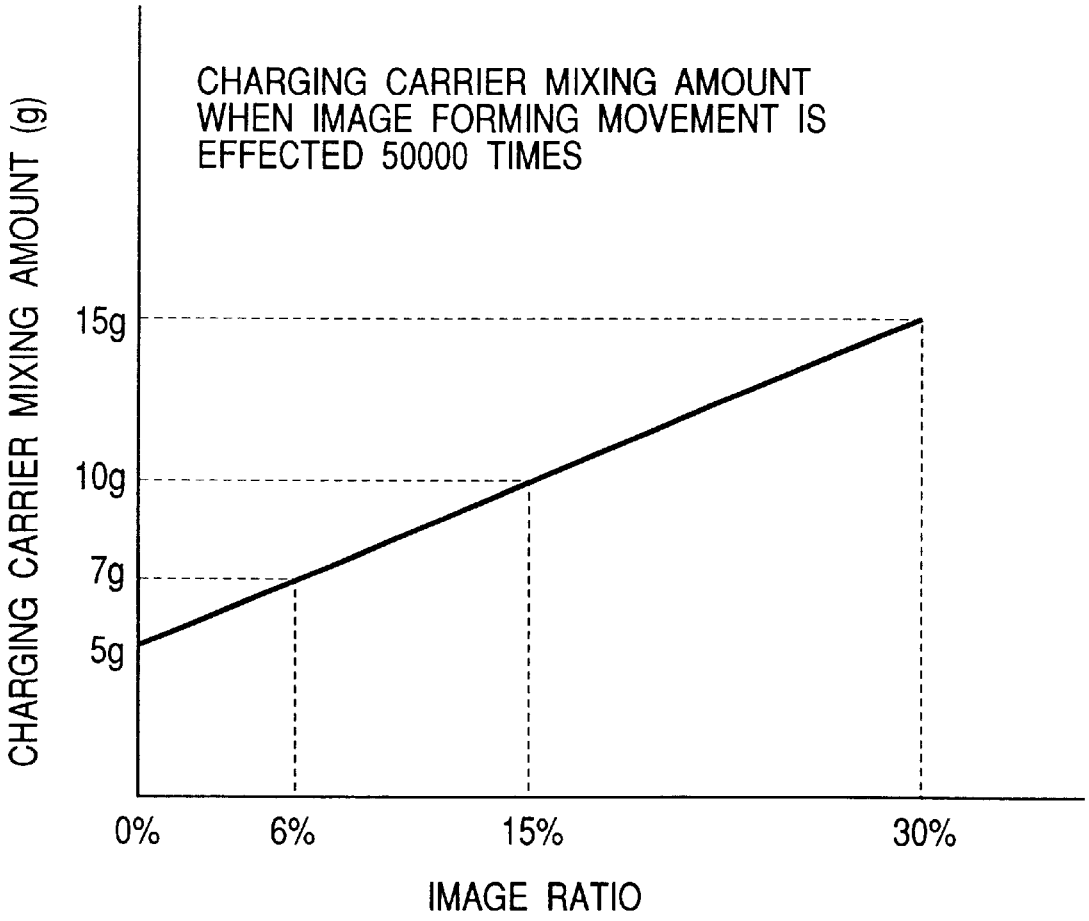
FIG. 11 is a graph showing that the mixing amount of charging carriers depends on an image ratio.

According to the study by the present inventors, it is found that, in the image forming apparatus according to this embodiment, if the image forming operation is repeated by 50,000 times in the originals different in the image density, the mixing amount of the charging carriers ca into the developing device 4 depends on the image density. Specifically, as shown in FIG. 11, because the resistance of the charging carriers ca and the photosensitive drum 1 becomes higher as the image density is high, strictly as the amount of toner consumption is large and the amount of remaining transfer toner collected by the charging device is large, the adhesion of the charging carriers ca onto the photosensitive drum 1 and the mixture into the two-component developer 47 of the developing device 4 increase for the above-mentioned reason.

For example, in the image the image ratio of which is 15%, the mixing amount of the charging carriers ca into the developing device 4 was about 10 g/50,000 times. Then, when the toner density is set to an optimum value and the detected signal of the inductance detecting sensor 53 is set to 2.5 V in this situation, if the charging carriers ca of 10 g are forcedly mixed with the developer 47, the apparent permeability of the developer 47 becomes larger. Accordingly, the detected signal from the inductance detecting sensor 53 when the initial optimum toner density is maintained goes up 0.5 V from the reference value 2.5 V to 3.0 V.

Therefore, because the toner is in fact replenished so that the detected signal becomes 2.5 V, the replenishment of toner is resultantly excessively conducted. Also, since the sensitivity of the inductance detecting sensor 53 used in the present image forming apparatus is 0.5 V/% (FIG. 7), as a result of repeating the image forming operation by 50,000 times, the toner density is finally shifted 1% from the optimum toner density 6% to 7% under control.

Similarly, in the image the image ratio of which is 30%, the mixing amount of the charging carriers ca into the developing device 4 was about 15 g. Then, when the toner density is set to an optimum value and the detected signal of the inductance detecting sensor 53 is set to 2.5 V in this situation, if the charging carriers ca of 15 g are forcedly mixed with the developer 47, the apparent permeability of the developer 47 becomes large. Accordingly, the detected signal from the inductance detecting sensor 53 when the initial optimum toner density is maintained goes up 0.75 V from the reference value 2.5 V to 3.25 V.

Therefore, because the toner is in fact replenished so that the detected signal becomes 2.5 V, the replenishment of toner is resultantly excessively conducted. Also, since the sensitivity of the inductance detecting sensor 53 used in the present image forming apparatus is 0.5 V/% (FIG. 7), as a result of repeating the image forming operation by 50,000 times, the toner density is finally shifted 1.5% from the optimum toner density 6% to 7.5% under control.

Under the above circumstance, in this embodiment, since there are provided a plurality of detected signal reference value correcting means for correcting the error-detection of the inductance detecting system ATR due to the mixture of the charging carriers ca with the developer 47 within the developing device 4 to hold the toner density constantly to a given value even if the image forming operation is repeated by the larger number of times, and a plurality of detected signal correcting means for estimating the mixing amount of the charging magnetic carriers with the developing device from the video count number of the image density signal. As a result, the above defects can be eliminated.

The details will be described. The detected signal reference value correcting means in this embodiment sets a command in the CPU 58 (FIG. 8) in advance so as to set the initial reference value of the inductance detecting sensor 53 to the reference value of the detected signal when the image forming operation is repeated for a given period of time or a given number of times. The CPU 58 newly sets the detected signal reference value outputted from the reference voltage signal source 55 at that timing.

More specifically, when the initial reference value of the inductance detecting sensor 53 is 2.5 V in the image ratio of 15%, since the mixing amount of the charging carriers ca is 10 g/50,000 times in proportion to the image forming operation if the image forming operation is repeated 25,000 times, the mixing amount becomes 5 g/25,000 times. In the inductance detecting sensor 53, when the charging carriers ca are mixed by 10 g, its value varies by 0.5 V. Therefore, the value varies by 0.25 V when the charging carriers ca of about 5 g are mixed.

Figure 9:
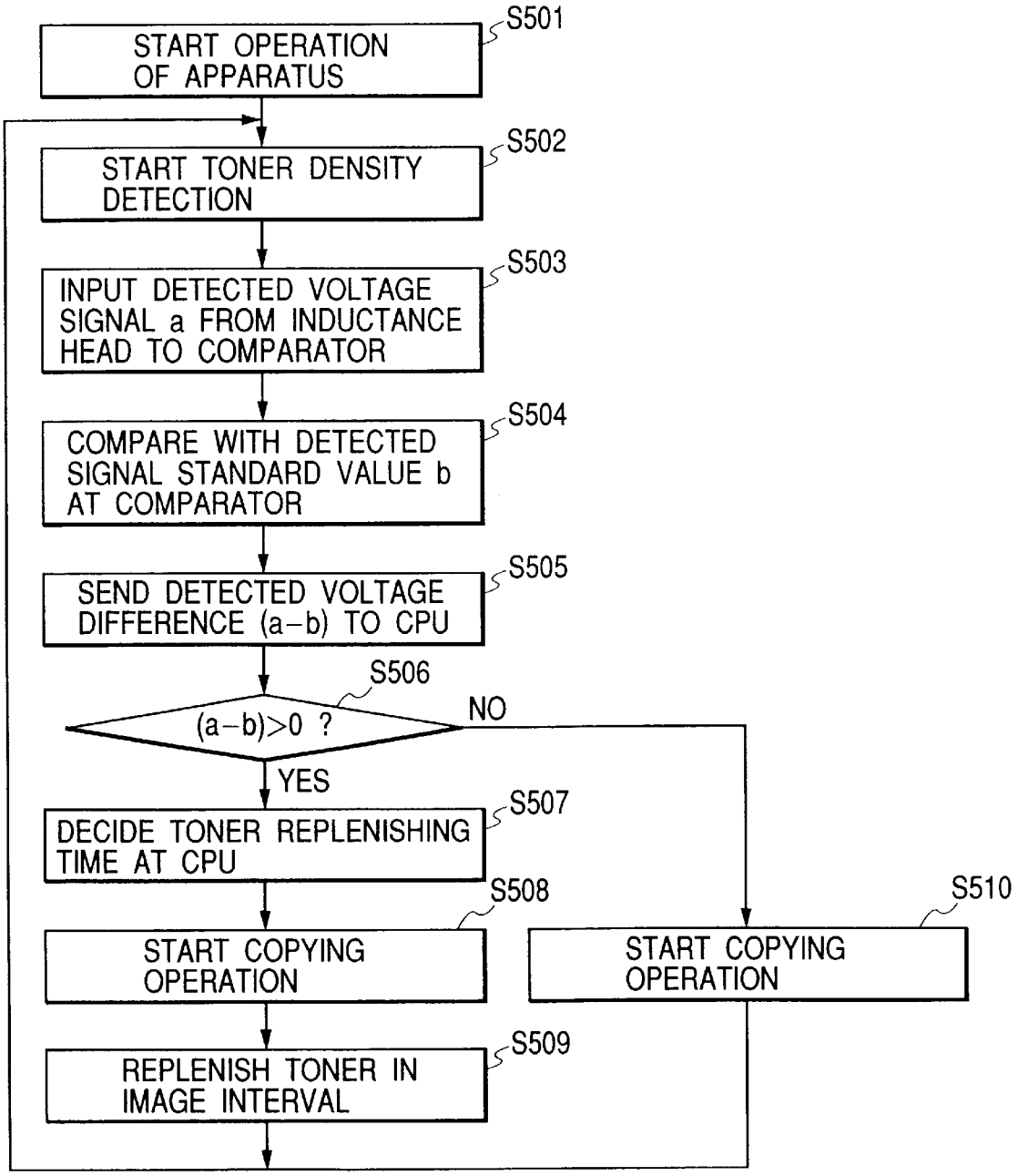
FIG. 9 is a flowchart showing the basic operation of the toner replenishment control system.

Therefore, a command is set on the CPU 58 in advance so that the reference value b of the detected signal in the block S504 of the flowchart shown in FIG. 9 is reset to 2.75 V. The CPU 58 resets the detected signal reference value outputted from the reference voltage signal source 55 to 2.75 V at that timing. Because the replenishment of toner stops until the detected signal becomes 2.75 V, an error in the toner density which is produced until then is eliminated, and the toner density is corrected to the initial toner density of 6% under control.

Figure 12A:
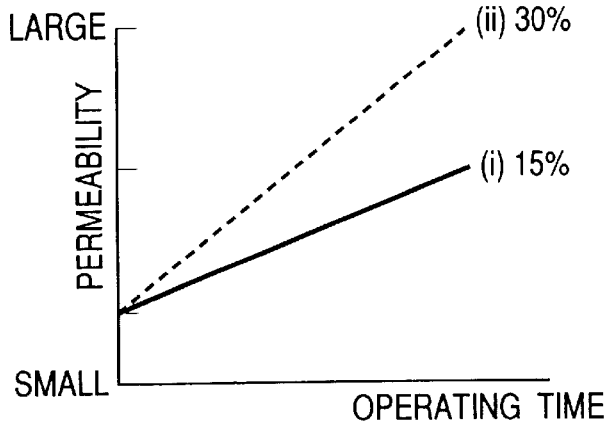
FIGS. 12A, 12B and 12C are graphs for explaining control in a first embodiment.
Figure 12B:
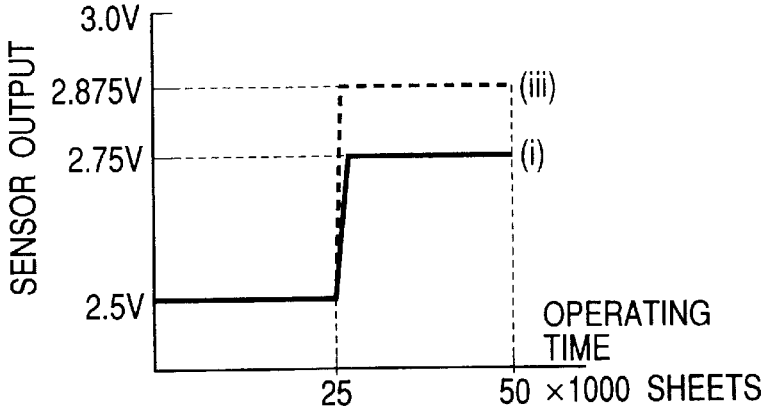
Figure 12C:
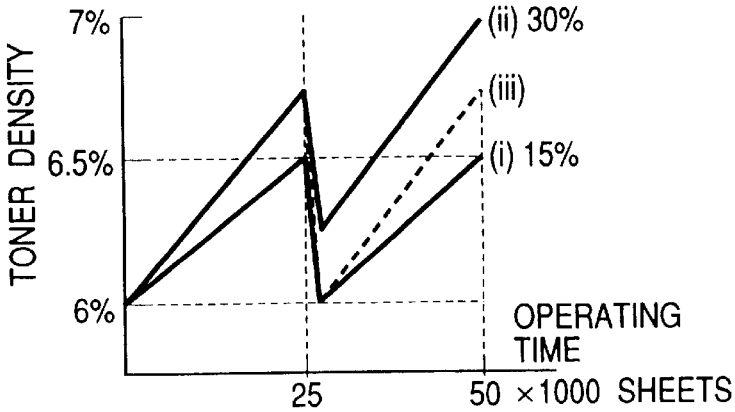

As a result, the toner density when the image forming operation is repeated 50,000 times is about 6.5%, and the error in the toner density control can be reduced as compared with a case in which the detected signal is not corrected ((i) of FIG. 12C).

However, in the image the image ratio of which is 30%, the mixing amount of the charging carriers ca becomes 7.5 g/25,000 times when the image forming operation is repeated 25,000 times since the mixing amount of the charging carriers ca is 15 g/50,000 times from the experiment. When the charging carriers ca of 7.5 g are mixed, the output of the inductance detecting sensor 53 produces an error of 0.375 V, as a result of which the toner density becomes 6.75%. However, when the image forming operation is repeated 25,000 times, if the reference value of the detected signal is reset to 2.75 V as in the image the image ratio of which is 15%, the replenishment of toner stops until the detected signal becomes 2.75 V. The error in the toner density which was caused until then is 0.75% corresponding to the output variation 0.375 V of the inductance detecting sensor 53 due to the mixing amount 7.5 g of the charging carriers ca. When 0.25 V is corrected, the toner density becomes 6.25% which is not equal to the initial toner density of 6%, as a result of which the toner density when the image forming operation is repeated 50,000 times becomes about 7.0% ((ii) of FIG. 12C) which is greatly shifted from the desired value.

Under the above circumstances, in order to solve the above problem, the estimation of the mixing amount of charging carriers is conducted by the video count system to control the toner density.

First, the video count system of the image density of the image information signal will be described.

Referring to FIG. 8, reference numeral 70 denotes an image reading device which photoelectrically reads the image information on an original 71 as a time-series electric digital pixel signal by an image reading unit made up of an original lighting lamp (not shown), an imaging lens 72, an image pickup array 73 and so on. The time-series electric digital pixel signal which is a photoelectric read signal of the original image from the image pickup array 73 is inputted to a laser beam scanner through an image signal processing circuit 74 and a pulse width modulating circuit 75.

Figure 13A:
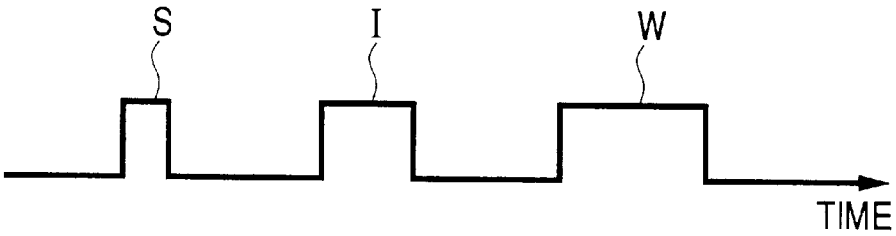
FIGS. 13A, 13B, 13C and 13D are views for explanation of video counting.
Figure 13B:
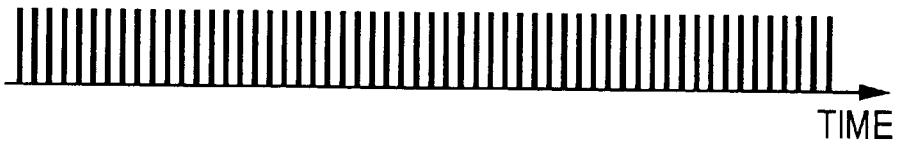
Figure 13C:
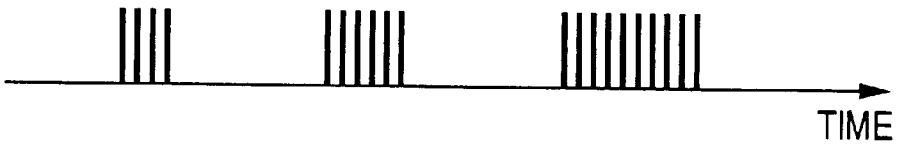
Figure 13D:
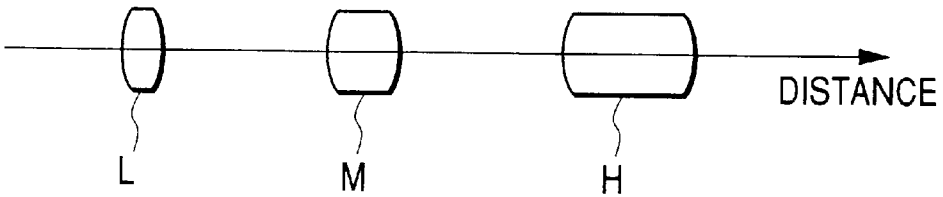

Also, the level of the output signal from the image signal processing circuit 74 is counted every pixels. The counting operation is made in the embodiment shown in FIG. 8 as follows. First, the output signal from the pulse width modulating circuit 75 is supplied to one input of an AND gate 76, and a clock pulse (a pulse shown in FIG. 13B) is supplied to the other input of the AND gate 76 from a clock pulse oscillator 77. Accordingly, the clock pulses of the number corresponding to the respective pulse widths of laser driving pulses S, I and W as shown in FIGS. 13A and 13C, that is, the clock pulses of the number corresponding to the density of the respective pixels are outputted from the AND gate 76. The number of clock pulses are counted by the counter 78 every image to calculate the video count number (The maximum video count number of one sheet A4 is $3884\times10^6$ in the gradation of 256 at 400 dpi). The pulse count signal C1 of each image from the counter 76 (video count number) corresponds to the toner amount consumed by the developing device 4 in order to form one toner image of the original 71.

Then, the video count number is stored in a RAM 79 while it is supplied to the CPU 56. The CPU 56 includes a conversion table representative of the correspondence between the video count number and the mixing amount of charging carriers. The detected signal reference value of the inductance detecting sensor 53 which is suited to the amount of charging carriers mixed in the developing device 4 is corrected or the reference value of the toner replenishment control is corrected on the basis of the inputted video count number, thereby being capable of controlling the density of toner less in the error.

Thus, in general, if the video count number is large, the correction value of the above reference value increases, whereas if the video count number is small, the correction value of the above reference value decreases.

In view of the above, the mixing amount of charging carriers is estimated in accordance with the integrating value and the number of times of the image forming operation due to the above video count system to correct the toner density control.

When the initial reference value of the inductance detecting sensor is 2.5 V in the image ratio of 15%, since the mixing amount of the charging carriers is 10 g/50,000 times in proportion to the image forming operation if the image forming operation is repeated 25,000 times, the mixing amount becomes 5 g/25,000 times. It is found that in the inductance detecting sensor 53, when the charging carriers are mixed by 10 g, its value varies by 0.5 V. Therefore, the value varies by 0.25 V when the charging carriers of about 5 g are mixed. Therefore, a command is set on the CPU 56 in advance so that the reference value b of the detected signal in the block S504 of the flowchart shown in FIG. 9 is reset to 2.75 V. The CPU 56 resets the detected signal reference value outputted from the reference voltage signal source 55 to 2.75 V at that timing. Because the replenishment of toner stops until the detected signal becomes 2.75 V, an error in the toner density which is produced until then is eliminated, and the toner density is corrected to the initial toner density of 6% under control. As a result, the toner density when the image forming operation is repeated 50,000 times is about 6.5%, and the error in the toner density control can be reduced as compared with a case in which the detected signal is not corrected ((i) of FIG. 12C).

However, in the image the image ratio of which is 30%, the mixing amount of the charging carriers becomes 7.5 g/25,000 times when the image forming operation is repeated 25,000 times since the mixing amount of the charging carriers is 15 g/50,000 times from the experiment. When the charging carriers of 7.5 g are mixed, the output of the inductance detecting sensor 53 produces an error of 0.375 V, as a result of which the toner density becomes 6.75%. However, when the image forming operation is repeated 25,000 times, if the reference value of the detected signal is reset to 2.75 V as in the image the image ratio of which is 15%, the replenishment of toner stops until the detected signal becomes 2.75 V. The error in the toner density which was caused until then is 0.75% corresponding to the output variation 0.375 V of the inductance detecting sensor 53 due to the mixing amount of the charging carriers 7.5 g. When 0.25 V is corrected, the toner density becomes 6.25% which is not equal to the initial toner density of 6%, as a result of which the toner density when the image forming operation is repeated 50,000 times becomes about 7.0% ((ii) of FIG. 12C) which is greatly shifted from the desired value.

As described above, however, the charging carriers are stuck 2.5 g/25,000 times regardless of the image ratio. Therefore, for example, if images are formed 25,000 times at the image ratio of 15%, it can be presumed that the remaining charging carriers of 2.5 g are the mixing amount of charging carriers to the developing device 4 which is caused by the charging failure due to the toners collected in the charging device 2.

Now, the integrating value of the video count number at that situation is $3884\times10\times0.15\times25{,}000=1457\times10^{10}$ counts, and the mixing amount of charging carriers is estimated as follows:

$$\text{The mixing amount of charging carriers (g)}=2.5/25{,}000\times(\text{the number of times of the image forming operation})+2.5\times(\text{video count integrating value}/1457\times10^{10}) \quad \text{expression (1)}$$

Then, in the image the image ratio of which is 30%, the video count number when the image forming operation is repeated 25,000 times is represented as follows:

$$3884\times10^{6}\times0.30\times25{,}000=2913\times10^{10}\ \text{counts}$$

The mixing amount of charging carriers (g) is estimated at 7.5 g from the expression (1). The error-detection of the detected signal at this time is as much as 0.375 V. When the reference value of the detected signal is reset to 2.875 V ((iii) of FIG. 12B), because the replenishment of toner stops until the detected signal becomes 2.875 V, an error in the toner density which has been caused until then is eliminated, and the toner density is re-controlled to the initial toner density of 6% ((iii) of FIG. 12C). As a result, the toner density when the image forming operation is repeated 50,000 times becomes about 6.75%, and an error in the toner density control can be reduced as compared with a case in which the reference value is changed by only the number of times of image forming operation for correction of the detected signal.

(Second Embodiment)

A command is set to the CPU 56 in advance so that the toner replenishment control correcting means in this embodiment resets a threshold value, which determines the toner replenishment start and stop in accordance with the detected signal of the comparator 51 shown in FIG. 8, in accordance with the video count number at the time when the image forming operation is repeated for a given period of time or a given number of times.

The CPU 56 sets the threshold value that determines the toner replenishment start and stop responsive to the detected signal of the comparator 54, to a new threshold value.

More specifically, in an image having an image ratio of 15%, a command is set to the CPU 56 in advance so that the initial toner replenishment control threshold value (a −b)>0 is reset to (a−b)>0.25 V in the block S506 of the flowchart shown in FIG. 9 when the image forming operation is repeated 25,000 times. At that timing, the CPU 56 resets the initial toner replenishment control threshold value (a−b)>0 to (a−b)>0.25. Because the replenishment of toner stops until the detected signal becomes 2.75 V, an error in the toner density which has been caused until then is eliminated, and the toner density is re-controlled to the initial toner density of 6%. As a result, the toner density when the image forming operation is repeated 50,000 times becomes about 6.5%, and an error in the toner density control can be reduced as compared with a case in which the correction of the detected signal is not changed in accordance with the circumstances.

Also, as described in the first embodiment, even if the image ratio is different, if the correction of the toner replenishment control threshold value is changed in accordance with the integrating value of the video count number, an error in the toner density control can be reduced.

(Third Embodiment)

In the first embodiment or the second embodiment, when the image forming operation is conducted by a given number of times, on the basis of the video count number and the number of times of image forming operation at that timing, the reference value b is reset to a new reference value by the detected signal reference value correcting means in the first embodiment, or the threshold value is set to a new threshold value by the toner replenishment control threshold value correcting means in the second embodiment. In the first and second embodiments, the toner density immediately before the reference value is corrected, is higher than a desired value as the image ratio is high, fog on the background or toner scattering is caused.

Figure 14A:
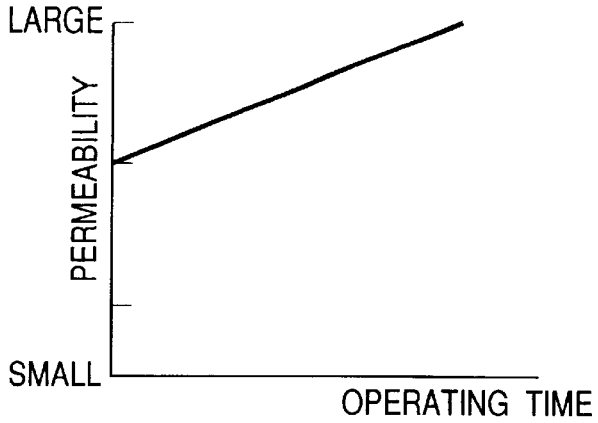
FIGS. 14A, 14B and 14C are graphs for explaining control in a third embodiment.
Figure 14B:
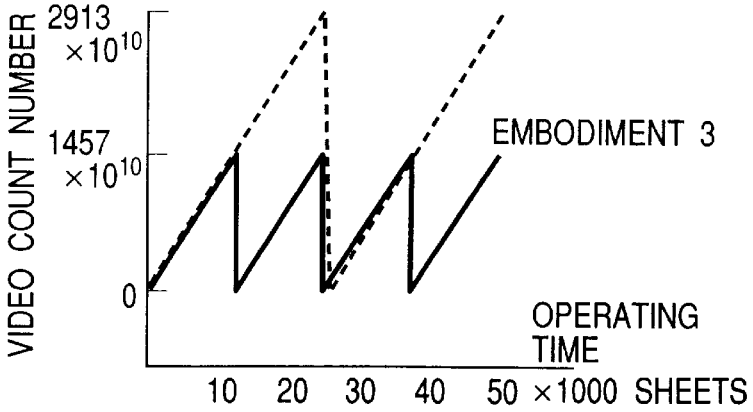
Figure 14C:
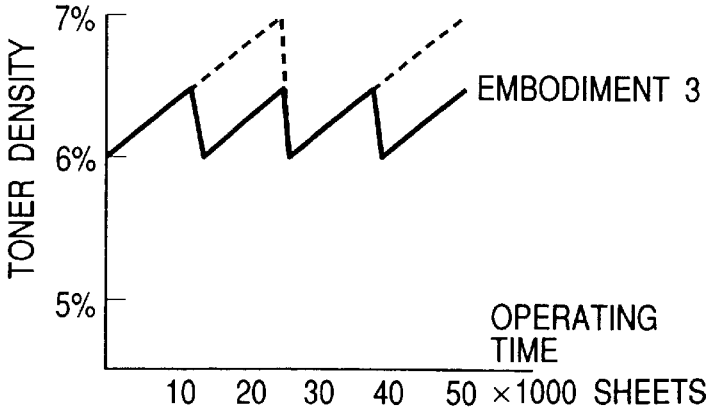
Figure 15:
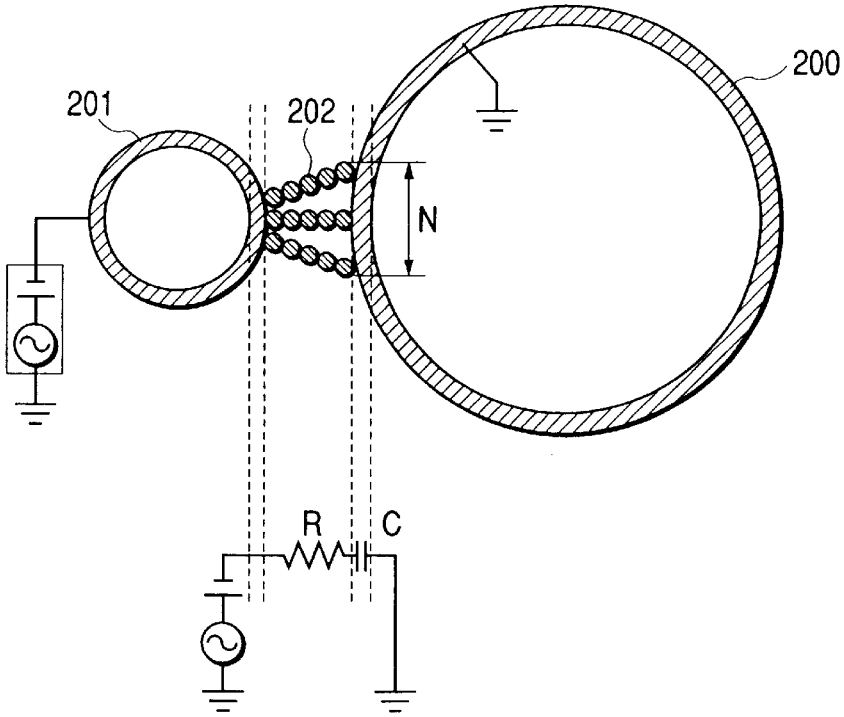
FIG. 15 is a diagram showing an equivalent circuit between a magnetic brush charging device and a photosensitive drum.
Figure 16:
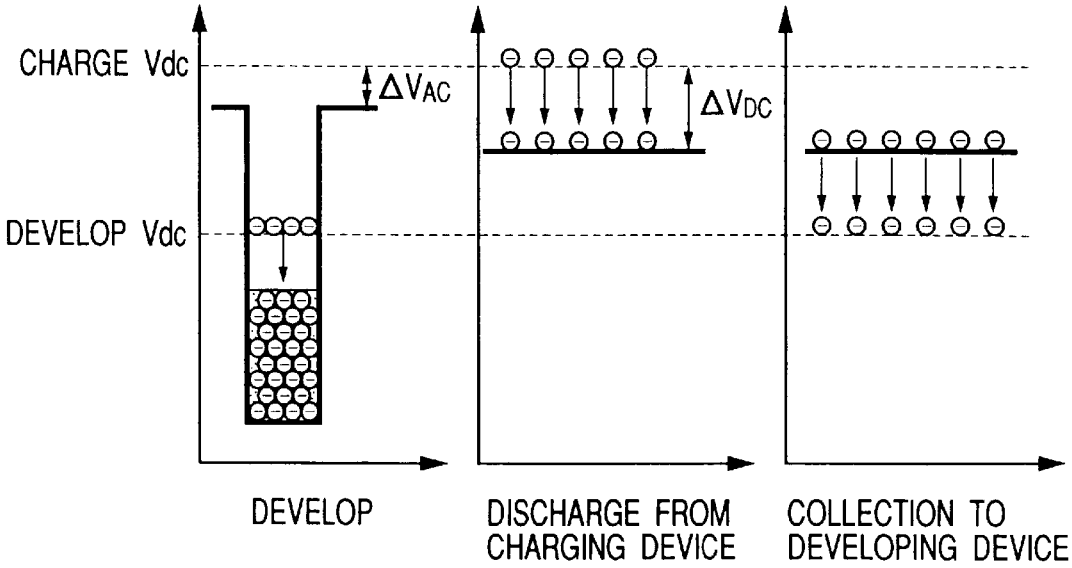
FIG. 16 is a diagram for the explanation of cleaning simultaneous with developing (cleanerless system)

Under the above circumstances, in this embodiment, the mixing amount of charging carriers is estimated at the time of reaching a given video count number, and the reference value or the threshold value is corrected (FIG. 14B). As a result, even if images different in the image ratio are outputted at random, the reference value or the threshold value can be always corrected when the mixing amount of charging carriers is a given value or less, so that an error in the toner density control can be more reduced.

Note that the respective embodiments described above are directed to a case in which the present invention is applied to a digital copying machine of the electrophotographic system. However, the present invention can be likewise applied to various copying machines of the electrophotographic system, the electrostatic recording system or the like and an image forming apparatus such as a printer, other than the above embodiments. For example, the present invention is applicable to an image forming apparatus that executes a variable-density expression of an image by a dither method. Also, the present invention is applicable to an image forming apparatus that forms a toner image in response to an image information signal outputted from a computer or the like. In addition, it is needless to say that the structures of the image forming apparatus and the control system, etc., can be variously modified and changed if necessary.

There is in fact no case in which only originals the image ratios of which are not changed are copied, and the estimation of the image ratio is calculated as the average image ratio on the basis of the past statistical absolute volume. The means for detecting the image ratio is mainly structured by means called "video count", which can be structurally equipped in the digital copying machine or the printer. The image ratio per se is judged as a ratio calculated from a numerical value obtained by video count.

In the case where an image is exposed directly on an image bearing member in an analog copying machine, there is provided no means for detecting the image ratio. However, in this case, control can be made according to the average image ratio statistically estimated from information on the number of copies and the past absolute volume.

(Fourth Embodiment)

In this embodiment, there is provided detected signal reference value correcting means for correcting the error-detection of an inductance detecting system ATR due to the mixture of charging carriers ca with the developer 47 within the developing device 4 and for holding the toner density constantly to a predetermined (given) value even if the large amount of image forming operation is repeated, and the correcting amount by the correcting means is determined according to information of an environment sensor.

Figure 17:
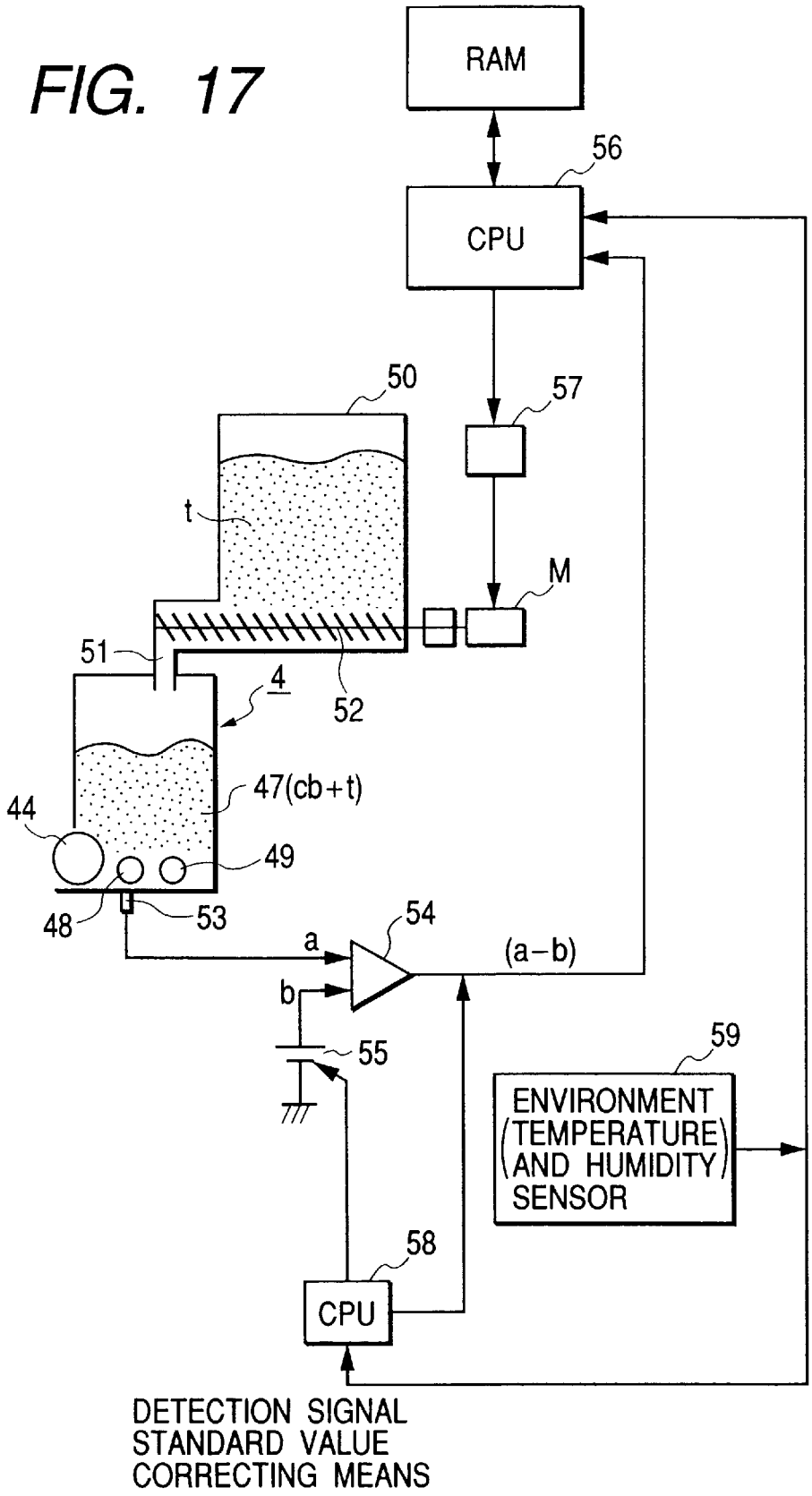
FIG. 17 is a block diagram showing a toner replenishment control system.

In a block circuit diagram shown in FIG. 17, reference numeral 59 denotes an environment sensor disposed on an image forming apparatus.

The details will be described. A command is set to the CPU 58 (FIG. 17) in advance so that the detected signal reference value control correcting means in this embodiment resets an initial reference value of the inductance detecting sensor 53 to the reference value of the detected signal when the image forming operation is repeated for a given period of time or a given number of times. At that timing, the CPU 58 newly sets the detected signal reference value outputted from the reference voltage signal source 55.

More specifically, when the initial reference value of the inductance detecting sensor 53 is 2.5 V in the circumstance where temperature is 25° C. and humidity is 50%, when the image forming operation is repeated 25,000 times, if the mixing amount of charging carriers ca is in proportion to the image forming operation, since the mixing amount of charging carriers is 10 g/50,000 times, the mixing amount becomes 5 g/25,000 times. In the inductance detecting sensor 53, when the charging carriers ca are mixed by 10 g, its value varies by 0.5 V. Therefore, the value varies by 0.25 V when the charging carriers of about 5 g are mixed.

Accordingly, a command is set to the CPU 58 in advance so that the reference value b of the detected signal in the block S504 of the flowchart shown in FIG. 9 is reset to 2.75 V. At that timing, the CPU 58 resets the detected signal reference value outputted from the reference voltage signal source 55 to 2.75 V. Because the replenishment of toner stops until the detected signal becomes 2.75 V, an error in the toner density which has been caused until then is eliminated, and the toner density is re-controlled to the initial toner density of 6%.

Figure 18A:
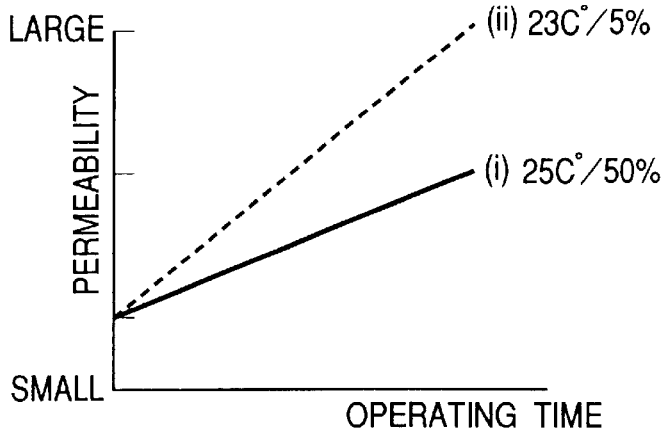
FIGS. 18A, 18B and 18C are graphs simply showing the relationship of a change in the apparent permeability of a developer, a detected signal of an inductance detecting sensor and the T/D ratio of the developer in fourth and fifth embodiments.
Figure 18B:
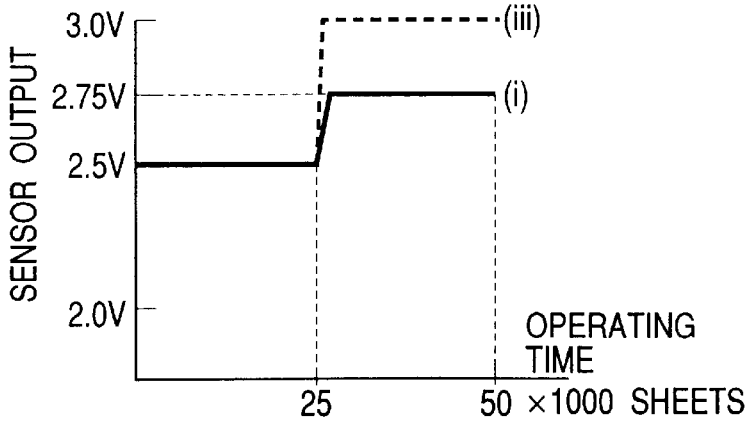
Figure 18C:
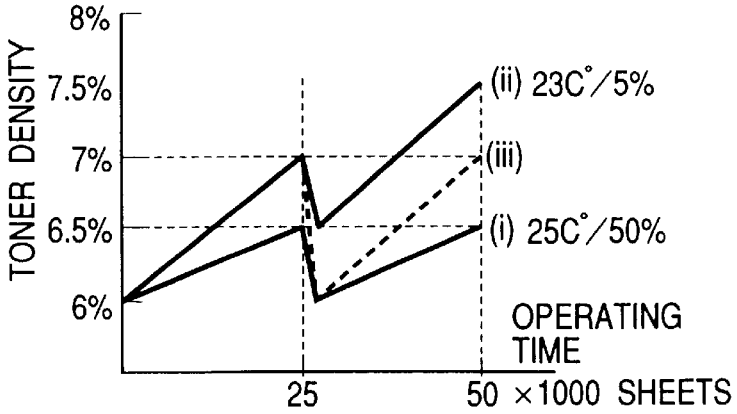

As a result, the toner density when the image forming operation is repeated 50,000 times becomes about 6.5%, and an error in the toner density control can be reduced as compared with a case in which the detected signal is not corrected ((i) of FIG. 18C).

However, in the environment where temperature is 23° C. and humidity is 5%, the mixing amount of charging carriers ca becomes 10 g/25,000 times when the image forming operation is repeated 25,000 times, since the mixing amount of charging carriers ca is 20 g/25,000 times from the experiment. When the charging carriers of 10 g are mixed, the output of the inductance detecting sensor 53 produces an error of 0.5 V, as a result of which the toner density becomes 7%. However, when the image forming operation is repeated 25,000 times, if the reference value of the detected signal is reset to 2.75 V as in the environment of 25° C. and 50%, the replenishment of toner stops until the detected signal becomes 2.75 V. The error in the toner density which was caused until then is 1% corresponding to the output variation 0.5 V of the inductance detecting sensor 53 due to the mixing amount 10 g of the charging carriers ca. When 0.25 V is corrected, the toner density becomes 6.5% which is not equal to the initial toner density of 6%, as a result of which the toner density when the image forming operation is repeated 50,000 times becomes about 7.5% ((ii) of FIG. 18C) which is greatly shifted from the desired value.

Under the above circumstances, if the mixing amount of charging carriers ca under a certain environment is estimated in advance and the reference value of the detected signal is changed in accordance with the environment, the above error in the toner density control can be reduced. In the above environment of 23° C. and 5%, if the reference value of the detected signal is reset to 3.0 V when the image forming operation is repeated 25,000 times ((iii) of FIG. 18B), because the replenishment of toner stops until the detected signal becomes 3.0 V, an error in the toner density which has been caused until then is eliminated, and the toner density is re-controlled to the initial toner density of 6% ((iii) of FIG. 18C). As a result, the toner density when the image forming operation is repeated 50,000 times becomes about 7%, and an error in the toner density control can be reduced as compared with a case in which the correction of the detected signal is not changed according to the environment.

(Fifth Embodiment)

A command is set to the CPU 56 in advance so that the toner replenishment control correcting means in this embodiment resets a threshold value, which determines the toner replenishment start and stop in accordance with the detected signal from the comparator 54 shown in FIG. 17, when the image forming operation is repeated for a given period of time or a given number of times. The CPU 56 sets the threshold value that determines the toner replenishment start and stop responsive to the detected signal from the comparator 54 to a new threshold value.

More specifically, under the environment where temperature is 25° C. and humidity is 50%, a command is set to the CPU 56 in advance so that the initial toner replenishment control threshold value (a–b)>0 is reset to (a–b)>0.25 V in the block S506 of the flowchart shown in FIG. 9 when the image forming operation is repeated 25,000 times.

At that timing, the CPU 56 resets the initial toner replenishment control threshold value (a–b)>0 to (a–b)>0.25. Because the replenishment of toner stops until the detected signal becomes 2.75 V, an error in the toner density which has been caused until then is eliminated, and the toner density is re-controlled to the initial toner density of 6%.

As a result, the toner density when the image forming operation is repeated 50,000 times becomes about 6.5%, and an error in the toner density control can be reduced as compared with a case in which the correction of the detected signal is not changed according to the environment.

Also, as described in the fourth embodiment, even if the environment is different, if the correction of the toner replenishment control threshold value is changed in accordance with various environments, an error in the toner density control can be reduced.

Figure 19A:
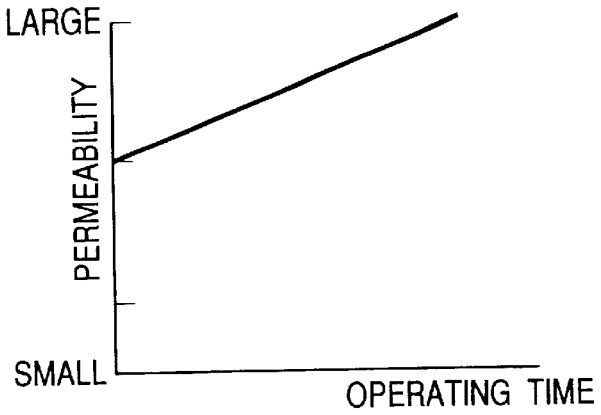
FIGS. 19A, 19B and 19C are graphs simply showing the relationship of a change in the apparent permeability of a developer, a detected signal of an inductance detecting sensor and the T/D ratio of the developer in a sixth embodiment.
Figure 19B:
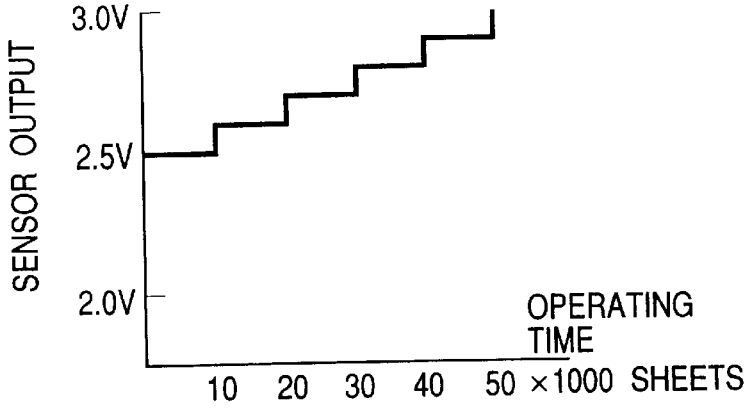
Figure 19C:
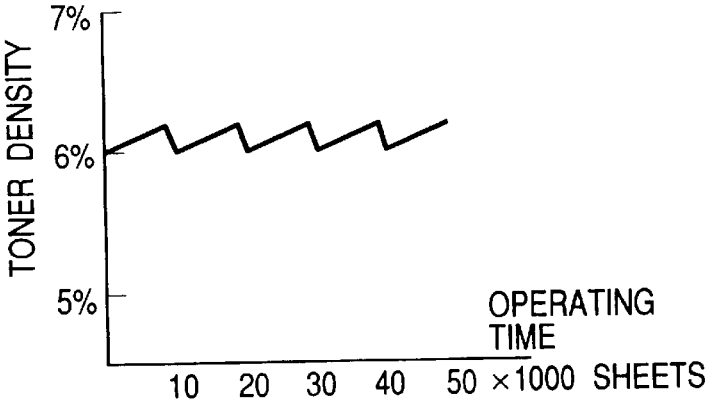

(Sixth Embodiment) (FIGS. 19A, 19B and 19C)

The reference value b newly set by the detected signal reference value correcting means in the fourth embodiment or the threshold value (a–b) newly set by the toner replenishment control correcting means in the fifth embodiment is newly phasedly set in accordance with various environments as shown in FIG. 19B, with the result that the toner density control high in accuracy can be conducted (FIG. 19C).

Figure 20A:
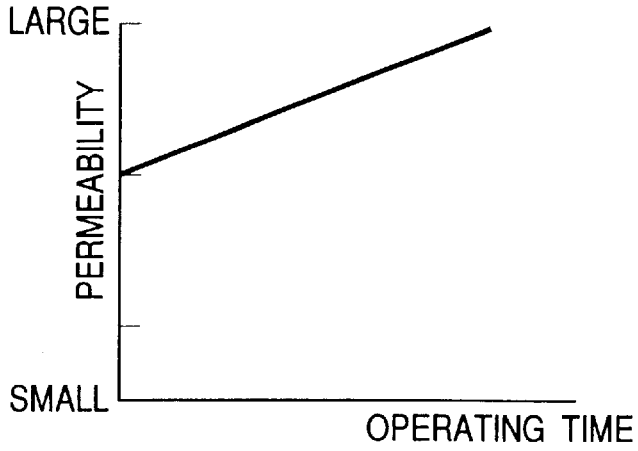
FIGS. 20A, 20B and 20C are graphs simply showing the relationship of a change in the apparent permeability of a developer, a detected signal of an inductance detecting sensor and the T/D ratio of the developer in a seventh embodiment.
Figure 20B:
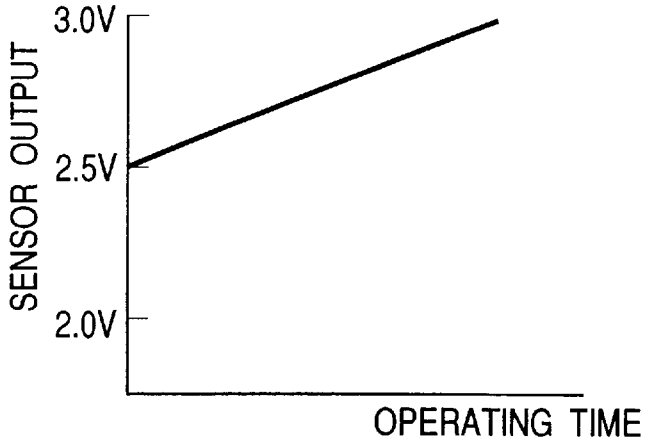
Figure 20C:
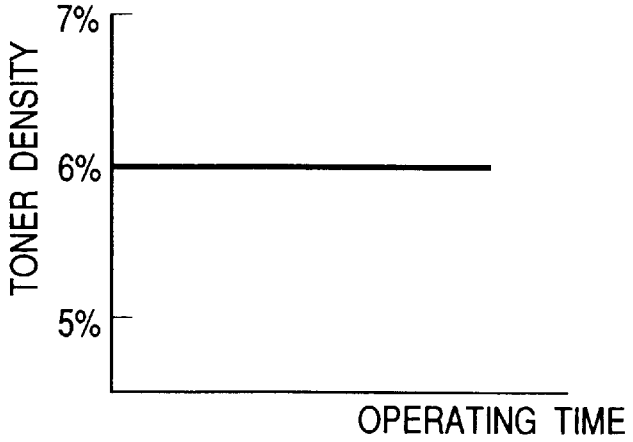

(Seventh Embodiment) (FIGS. 20A, 20B and 20C)

The reference value b newly set by the detected signal reference value correcting means in the fourth embodiment or the threshold value (a–b) newly set by the toner replenishment control correcting means in the fifth embodiment is newly linearly set in accordance with various environments as shown in FIG. 20B, with the result that the toner density control high in accuracy can be conducted (FIG. 20C).

Figure 21A:
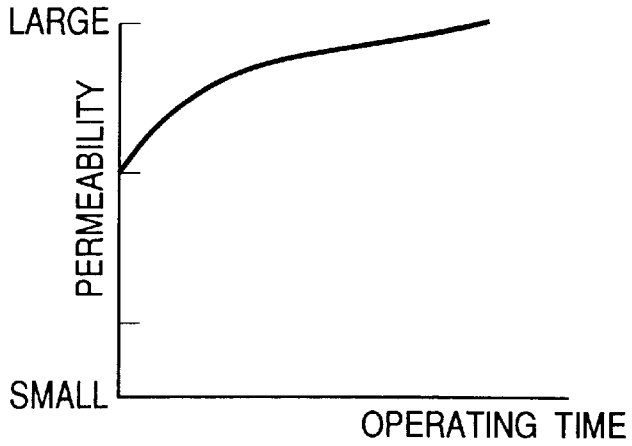
FIGS. 21A, 21B and 21C are graphs simply showing the relationship of a change in the apparent permeability of a developer, a detected signal of an inductance detecting sensor and the T/D ratio of the developer in an eighth embodiment.
Figure 21B:
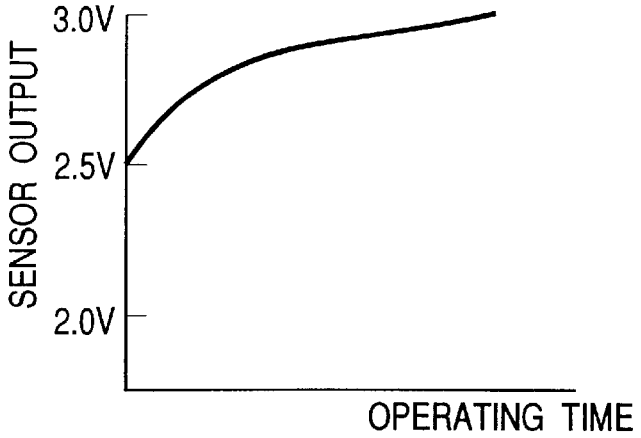
Figure 21C:
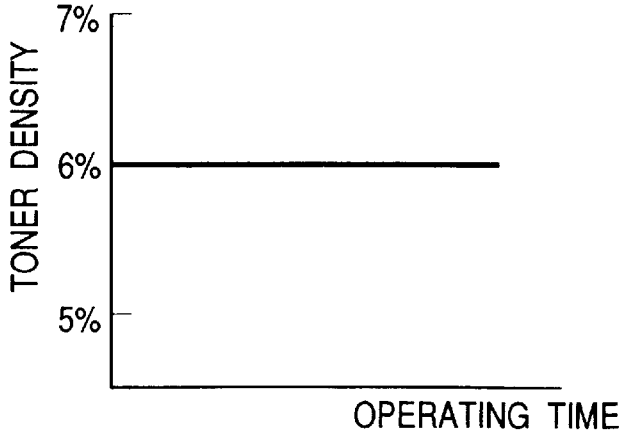

(Eighth Embodiment) (FIGS. 21A, 21B and 21C)

The charging carriers ca have the distribution of their grain diameters widened to some degree, and it is found from the prevent inventors' study that the fine charging carriers are liable to be stuck. It is presumed that such fine charging carriers are caused to be stuck particularly when the period of time or the number of times of image forming operation is initial, and a change in the apparent permeability of the initial developer 47 becomes large. Thereafter, when the fine charging carriers are reduced on the charging device 2 side, the change in the apparent permeability of the developer 47 becomes gradually small so as to be non-linearly changed (FIG. 21A).

Accordingly, the reference value b newly set by the detected signal reference value correcting means in the fourth embodiment or the threshold value (a–b) newly set by the toner replenishment control correcting means in the fifth embodiment is newly phasedly set in accordance with various environments as shown in FIG. 21B, with the result that the toner density control high in accuracy can be conducted (FIG. 21C).

Subsequently, a description will be given of how to control in order that how timing the reference value b newly set by the detected signal reference value correcting means in the above embodiment or the threshold value (a–b) newly set by the toner replenishment control correcting means in the fifth embodiment, is newly set.

Since the adhesion of charging carriers occurs during the operation of the charging device 2 and the photosensitive drum 1, the adhering amount of charging carriers can be relatively easily notified of if control is conducted from information on the number of sheets on which the image is formed.

Therefore, in this embodiment, the reference value b newly set by the detected signal reference value correcting means is determined on the basis of the information on the number of sheets be copied as represented by the expression (2) as one example. For example, if the initial detected signal reference value b is 2.5 V, the detected signal reference value increases 0.01 V every time 1,000 sheets are copied so that the detected signal reference value becomes 3.0 V when 5,000 sheets are copied.

As a result, even if the period of time or the number of times of image forming operation increases, the T/C ratio control little in error can be conducted.

Detected signal reference value $b$=2.5+0.01×(the number of copied sheets/1000) expression (2)

Similarly, the threshold value (a–b) newly set by the toner replenishment control correcting means is determined in accordance with information on the number of sheets to be copied as shown in the expression (3), and for example, if the initial toner replenishment control threshold value (a–b) >0, the toner replenishment control threshold value increases 0.01 V every time 1,000 sheets are copied so that the toner replenishment control threshold value becomes 0.5 V when 50,000 sheets are copied.

As a result, even if the period of time or the number of times of image forming operation increases, the T/C ratio control little in error can be conducted.

Toner replenishment control threshold value ($a-b$)=0.01×(the number of copied sheets/1000) expression (3)

Also, as another example, since the adhesion of charging carriers occurs during the operation of the charging device 2 and the photosensitive drum 1, the reference value b newly set by the detected signal reference value correcting means is gradually set to a new reference value as shown in the expression (4) in accordance with the initial detected signal reference value on the basis of a value calculated from a conversion table on the basis of a period of time during which the charging device 2 or the photosensitive drum 1 is driven.

In the above control method, because information that the period of time during which the charging device or the photosensitive drum is driven depends on the size of the sheet to be copied, which is not contained in the above information on the number of sheets to be copied is not considered, even if the period of time or the number of times of image forming operation increases, the T/C ratio control little in error can be conducted.

Detected signal reference value $b$=2.5+0.01×(a value calculated from the period of driving the charging device or photosensitive drum) expression (4)

Also, similarly, the threshold value (a–b) newly set by the toner replenishment control threshold value correcting means is gradually set to a new threshold value as shown in the expression (5) in accordance with the initial detected signal threshold value on the basis of a value calculated from a conversion table on the basis of a period of time during which the charging device 2 or the photosensitive drum 1 is driven.

In the above control method, because information that the period of time during which the charging device or the photosensitive drum is driven depends on the size of the sheet to be copied, which is not contained in the above information on the number of sheets to be copied is not considered, even if the period of time or the number of times of image forming operation increases, the T/C ratio control little in error can be conducted.

Toner replenishment control threshold value $(a-b)=0.01\times$(a value calculated from the period of driving the charging device or photosensitive drum) expression (5)

In this example, there is in fact no case in which the originals are copied on a location where the environments of temperature and humidity are not changed, and temperature and humidity are normally continuously changed. Accordingly, the reason why the mixing amount of charging carriers is measured under the environments where temperature and humidity are constant is to prove that the mixing amount of charging carriers depends on the temperature and humidity, and the mixing amount is substantially in proportion to the number of copied sheets and to obtain the mixing amount of charging carries per one image forming operation at given temperature and humidity.

Figure 22:
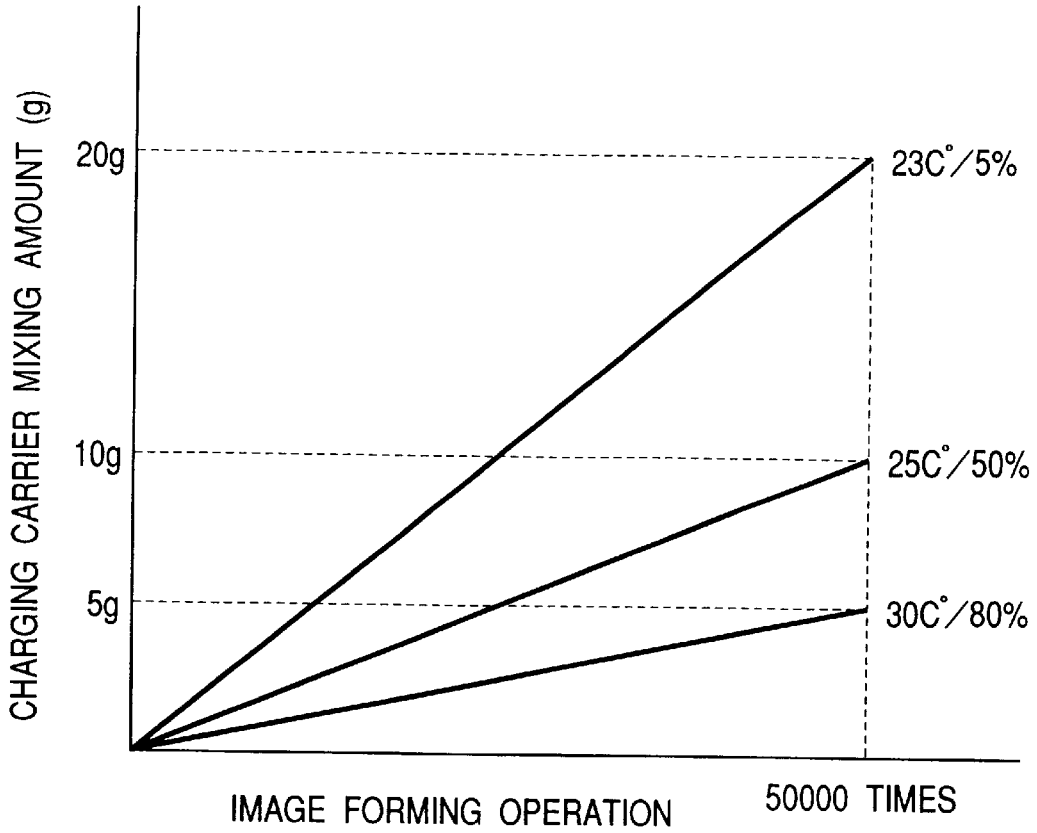
FIG. 22 is a graph showing that the mixing amount of charging carriers depends on temperature and humidity.

More particularly, since the mixing amount of charging carries per one image forming operation at various temperature and humidity is obtained from a graph shown in FIG. 22, if the image forming operation is repeated 10,000 times under the environments of 23° C. and 5%, 10,000 times under the environments of 23° C. and 50% and 10,000 times under the environments of 30° C. and 80%, the mixing amount of charging carriers at that time is obtained from the following expression.

$$(20/50{,}000)\times 10{,}000+(10/50{,}000)\times 10{,}000+(5/50{,}000)\times 10{,}000 = 7\ \text{g}$$

It is needless to say that even if there is no extreme change of the environments as described above, if the mixing amount of charging carriers per one image forming operation under a certain temperature and humidity environment is integrally counted, it is considered that there arises no problem of environment history.

(Others)

1) The magnetic brush charging member is not limited to the sleeve rotation type but applicable to the structure in which a magnet roll is rotatable, the structure in which the surface of the magnet roll is electroconductively processed as a feeder electrode if necessary, and electrically conductive magnetic particles are magnetically bound directly on the outer peripheral surface of the magnet roll to form a magnetic brush portion and rotate the magnet roll, and so on. Also, the magnetic brush charging member may be of the non-rotating type.

2) If the photosensitive drum as an image bearing member has a low-resistant layer of $10^{9}$ to $10^{14}$ Ω·cm, the charge injecting charging can be realized which is desirable from the viewpoint of preventing ozone from generating. However, the image bearing member of the present invention may be formed of an organic photosensitive member or the like other than the above structure. That is, the constant charging is not limited to the charge injecting charging type but may be of a contact charging type controllable by the discharge phenomenon.

3) The two-component developing device of the contact type brings the developer into contact with the image bearing member to develop a latent image is effective in enhancing the effect of collecting the remaining transfer toner simultaneously with developing in the cleanerless system. Also, in the case where polymer toner is used as the toner particles in the developer, a satisfactory collecting effect is obtained. The developing device may be of the reversal developing system or the normal developing system.

4) As the AC (alternating voltage, a.c. voltage) waveform, appropriate waveforms such as a sine waveform, a rectangular waveform or a triangular waveform are applicable. Also, a rectangular waveform formed by periodically turning on/off a d.c. power supply may be applied. Thus, as the waveform of the a.c. voltage, a bias a voltage value of which is periodically changed can be employed.

5) The imaging process in the image forming apparatus is not limited to the above embodiments but arbitrary. Also, if necessary, another auxiliary process equipment may be added.

The image exposing means for forming an electrostatic latent image is not limited to laser scanning exposing means for forming a digital latent image as in the above embodiments, but may be formed of a normal analog image exposure, another light emitting element such as LED, or the structure in which an electrostatic latent image can be formed in response to image information, such as the combination of a light emitting element such as a fluorescent lamp with a liquid-crystal shutter or the like.

The image bearing member may be made of an electrostatic recording dielectric material. In this case, after the dielectric surface is primarily charged uniformly to a given polarity and potential, it is selectively electrically erased by electricity erasing means such as an electricity erasing needle head or an electron gun to write and form an objective electrostatic latent image.

6) The transfer material to which a toner image is transferred from the image bearing member may be formed of an intermediate transfer member such as a transfer drum.

7) The transferring means is not limited to a transfer belt device in the above embodiments but arbitrary such as corona discharge transferring, roller transferring, or blade transferring.

8) The present invention is not limited to cleanerless but may be applied to an image forming apparatus with a specific cleaner that removes the transfer remaining toner from the image bearing surface.

9) The image forming apparatus in the above embodiments is directed to a monochrome image formation (mono-color), but the present invention can obtain a full-color image by providing photosensitive members, charging devices, developing devices and exposing devices for each color of yellow, magenta, cyan and black and sequentially transferring the toner images on the respective photosensitive members onto a transfer material of a belt-like or cylindrical transfer material holding member.

In other words, if the intermediate transfer member such as a transfer drum or a transfer belt is used, the present invention is applicable to not only monochrome image formation but also an image forming apparatus that forms a multi-color or full color image due to multi-transfer or the like.

10) The present invention can be formed of a process cartridge detachable type device in which an arbitrary process equipment such as the image bearing member 1, the charging device 2, the developing device 4 or the like can be detachably attachable to the image forming apparatus body together.

11) There is an image display device in which the electrophotographic photosensitive member or the electrostatic recording dielectric member as the image bearing member is of the rotating belt type, a toner image corresponding to image information is formed on the image bearing member by the charging, electrostatic latent image forming and developing means, the toner image forming portion is located on a reading display portion to display an image, and the image bearing member is repeatedly used for formation of a display image. The image forming apparatus of the present invention includes the above image display device.

12) The present invention is applicable to an image forming device that executes variable-density expression of an image by a dither method. Also, the present invention is applicable to not copying of an original but an image forming device that forms a toner image in response to an image information signal outputted from a computer or the like.

The image forming apparatus may be of the transfer system but the direct system.

In addition, it is needless to say that the structures of the image forming apparatus and the control system, etc., can be variously modified and changed if necessary.

As was described above, according to the embodiments of the present invention, in the image forming apparatus of the magnetic brush contact charging system and the two-component developing system, even if the charging carriers on the magnetic brush charging device side are mixed with the two-component developer on the developing device side and stored therein, the toner density control by the inductance detecting sensor of the developing device can be more reduced in the error.

In the case where the charging carriers used for magnetic brush charging are carried into the developing device and mixed with the two-component developer and stored therein because the charging carriers are stuck onto the image bearing member or the like, the mixing ratio of the charging carriers into the developing device differs due to a difference of the image density, as a result of which the ratio at which the average permeability of the entire developer, which is the optimum toner density, changes due to a difference in the permeability between the charging carriers and the developing carriers differs due to the difference of the image density. Even in this case, since the ratio of correcting the reference value of the detected signal of the inductance detecting sensor or the reference value of the toner replenishment control is changed in response to information from the video count number of the image density signal, even if the image forming operation is repeated on the originals having various image densities, because the replenishment of toner is always appropriately conducted, the toner density control (T/D ratio control) less in the error can be conducted.

In the case where the charging carriers used for magnetic brush charging are carried into the developing device and mixed with the two-component developer and stored therein because the charging carriers are stuck onto the image bearing member or the like, the mixing ratio of the charging carriers into the developing device differs due to a difference of the environments (temperature and humidity), as a result of which the ratio at which the average permeability of the entire developer, which is the optimum toner density, changes due to a difference in the permeability between the charging carriers and the developing carriers differs due to the difference of the temperature and humidity. Even in this case, since the ratio of correcting the reference value of the detected signal of the inductance detecting sensor or the reference value of the toner replenishment control is changed under various environments in response to information from the environment sensor, even if the image forming operation is repeated under various environments, because the replenishment of toner is always appropriately conducted, the toner density control (T/D ratio control) less in the error can be conducted.

What is claimed is:

1. An image forming apparatus, comprising:

an image bearing member for bearing a latent image;

charging means for charging said image bearing member by bringing ears of electrically conductive particles into contact with said image bearing member;

developing means for visualizing the latent image formed on said image bearing member as a toner image by using a developer containing toner and carrier after said image bearing member has been charged by said charging means, a permeability of the carriers being different from a permeability of the electrically conductive particles;

density control means for controlling a density of the developer within said developing means, said density control means detecting a permeability of the developer, comparing a detected signal value based on the detected result with a reference value, and controlling the density of the developer on the basis of a comparison result; and reference value correcting means for correcting the reference value, said reference value correcting means estimating an amount of the electrically conductive particles that enter within said developing means, and correcting the reference value on the basis of the estimated result.

2. An image forming apparatus according to claim 1, further comprising transferring means for transferring the toner image onto a member to be transferred, wherein the toner remaining on said image bearing member after transfer by said transferring means is brought into contact with the electrically conductive particles of said charging means to be given the charges.

3. An image forming apparatus according to claim 2, wherein the toner that brought into contact with the electrically conductive particles to be charged is collected by said developing means.

4. An image forming apparatus according to claim 1, wherein the electrically conductive particles include magnetic particles.

5. An image forming apparatus according to claim 1, wherein said reference value correcting means estimates an amount of the electrically conductive particles that enter within said developing means, on the basis of number of times of an image forming operation.

6. An image forming apparatus according to claim 1, wherein said reference value correcting means estimates an amount of the electrically conductive particles that enter within said developing means, on the basis of a period of time during which an image forming operation is effected.

7. An image forming apparatus according to claim 1, further comprising exposing means for exposing said image bearing member on the basis of an image signal to form a latent image, wherein said reference value correcting means estimates the amount of the electrically conductive particles that enter within said developing means, on the basis of the image signal.

8. An image forming apparatus according to claim 7, wherein said reference value correcting means estimates an amount of the electrically conductive particles that enter within said developing means, on the basis of density information of the image signal.

9. An image forming apparatus according to claim 8, wherein said reference value correcting means estimates an amount of the electrically conductive particles that enter within said developing means, on the basis of an integrating value of a density level of the image signal for each pixel.

10. An image forming apparatus according to claim 1, further comprising exposing means for exposing said image bearing member on the basis of an image signal to form a latent image, wherein said reference value correcting means estimates an amount of the electrically conductive particles that enter within said developing means, on the basis of a number of times of an image forming operation and the image signal.

11. An image forming apparatus according to claim 1, further comprising exposing means for exposing said image bearing member on the basis of an image signal to form a latent image, wherein said reference value correcting means effects corrections every time an integrating value of a density level of the image signal for each pixel reaches a predetermined value.

12. An image forming apparatus according to claim 1, further comprising environment detecting means for detecting environmental conditions, wherein said reference value correcting means estimates an amount of the electrically conductive particles that enter within said developing means, on the basis of a detected result of said environment detecting means.

13. An image forming apparatus according to claim 12, wherein said environment detecting means includes a temperature and humidity sensor.

14. An image forming apparatus according to claim 12, wherein said reference value correcting means phasedly corrects the reference value with an increase in number of times of an image forming operation.

15. An image forming apparatus according to claim 12, wherein said reference value correcting means linearly corrects the reference value with an increase in a number of times of an image forming operation.

16. An image forming apparatus according to claim 1, wherein said reference value correcting means nonlinearly corrects the reference value with an increase in a number of times of an image forming operation.

17. An image forming apparatus, comprising:

an image bearing member for bearing a latent image; charging means for charging said image bearing member by bringing ears of electrically conductive particles into contact with said image bearing member;

developing means for visualizing a latent image formed on said image bearing member as a toner image by using a developer containing toner and carrier after said image bearing member has been charged by said charging means, a permeability of particles of the carriers being different from a permeability of the electrically conductive particles;

density control means for controlling density of the developer within said developing means, said density control means detecting a permeability of the developer, comparing a difference between a detected signal value based on the detected result and a reference value with a threshold value, and controlling the density of the developer on the basis of the comparison result; and threshold value correcting means for correcting the threshold value, said threshold value correcting means estimating an amount of the electrically conductive particles that enter within said developing means and correcting the threshold value on the basis of the estimated result.

18. An image forming apparatus according to claim 17, further comprising exposing means for exposing said image bearing member on the basis of an image signal to form the latent image, wherein said threshold value correcting means estimates an amount of the electrically conductive particles that enter within said developing means, on the basis of the image signal.

19. An image forming apparatus according to claim 18, wherein said threshold value correcting means estimates an amount of the electrically conductive particles that enter within said developing means, on the basis of density information of the image signal.

20. An image forming apparatus according to claim 19, wherein said threshold value correcting means estimates an amount of the electrically conductive particles that enter within said developing means, on the basis of an integrating value of a density level of the image signal for each pixel.

21. An image forming apparatus according to claim 17, further comprising exposing means for exposing said image bearing member on the basis of an image signal to form a latent image, wherein said threshold value correcting means estimates an amount of the electrically conductive particles that enter within said developing means, on the basis of a number of times of image forming operation and the image signal.

22. An image forming apparatus according to claim 17, further comprising exposing means for exposing said image bearing member on the basis of an image signal to form a latent image, wherein said threshold value correcting means effects the correction every time an integrating value of a density level of an image signal for each pixel reaches a predetermined value.

23. An image forming apparatus according to claim 17, further comprising environment detecting means for detecting environmental conditions, wherein said threshold value correcting means estimates the amount of the electrically conductive particles that enter within said developing means, on the basis of a detected result of said environment detecting means.

24. An image forming apparatus according to claim 23, wherein said environment detecting means includes a temperature and humidity sensor.

25. An image forming apparatus according to claim 23, wherein said threshold value correcting means phasedly corrects the threshold value with an increase in a number of times of an image forming operation.

26. An image forming apparatus according to claim 23, wherein said threshold value correcting means linearly corrects the threshold value with an increase in a number of times of an image forming operation.

27. An image forming apparatus according to claim 23, wherein said threshold value correcting means non-linearly corrects the threshold value with an increase in a number of times of an image forming operation.

28. An image forming apparatus comprising:

an image bearing;

charging means for charging said image bearing member;

developing means for developing a latent image formed on said image bearing member with a developer having a toner and carrier;

detecting means for detecting information corresponding to a permeability of the developer in said developing means;

control means for controlling an amount of the developer being replenished to said developing means in accordance with an output of said detecting means and a desired value, wherein said charging means bring magnetic particles in contact with said image bearing member, and a permeability of the magnetic particle is different from a permeability of the carrier; and correcting means for correcting the desired value.

29. An image forming apparatus according to claim 28, wherein said correcting means corrects the desired value in accordance with a number of an image formation operations.

30. An image forming apparatus according to claim 28 wherein said correcting means corrects the desired value in accordance with a time in which an image formation operation is effected.

31. An image forming apparatus according to claim 28, further comprising environment detecting means for detecting an environment, wherein said correcting means corrects the desired value in accordance with an output of said environment detecting means.

32. An image forming apparatus according to any one of claims 28 to 31, further comprising image forming means for forming the latent image on said image bearing member based on an image signal, wherein said correcting means corrects the desired value in accordance with the image signal.

33. An image forming apparatus according to claim 32, wherein said correcting means corrects the desired value in accordance with density information of the image signal.

34. An image forming apparatus according to claim 28, wherein said charging means charges said image bearing member using an injection charging system.

35. An image forming apparatus according to claims 28 or 34, wherein said charging means charges toner remaining on said image bearing member after a toner image on said image bearing member is transferred to a body to be transferred.

36. An image forming apparatus according to claim 1, wherein said charging means comprises an injection changing system to charge said image bearing member.

37. An image forming apparatus according to claim 17, wherein said charging means comprises an injection charging system to charge said image charging system.

38. An image forming apparatus according to claim 34, wherein the toner on said image bearing member charged by said charging means is collected in said developing means.

* * * * *

UNITED STATES PATENT AND TRADEMARK OFFICE

CERTIFICATE OF CORRECTION

PATENT NO. : 6,345,162 B1
DATED : February 5, 2002
INVENTOR(S) : Ichiro Ozawa et al.

It is certified that error appears in the above-identified patent and that said Letters Patent is hereby corrected as shown below:

Column 7,
Line 66, “simultaneous” should read -- simultaneously --.

Column 17,
Line 14, “too” should be deleted; and
Line 15, “too” should be deleted.

Column 18,
Line 15, “enons” should read -- ena --.

Column 20,
Line 44, “number” should read -- member. --.

Column 21,
Line 37, “image” (first occurrence) should read -- image, --.

Column 23,
Line 22, “originals” should read -- originals, --.

Column 30,
Line 26, “be given the charges.” should read -- be charged. --; and
Line 47, “the” (first occurrence) should read -- an --.

Column 32,
Line 41, “bearing.” should read -- bearing member; --;
Line 61, “operations.” should read -- operation. --; and
Line 62, “claim 28” should read -- claim 28, --.

UNITED STATES PATENT AND TRADEMARK OFFICE

CERTIFICATE OF CORRECTION

PATENT NO. : 6,345,162 B1
DATED : February 5, 2002
INVENTOR(S) : Ichiro Ozawa et al.

It is certified that error appears in the above-identified patent and that said Letters Patent is hereby corrected as shown below:

Column 34,
Line 6, “chang-” should read -- charg- --; and
Line 10, “charging system.” should read -- bearing member. --.

Signed and Sealed this

Twenty-second Day of October, 2002

*Attest:*

*Attesting Officer*

JAMES E. ROGAN
*Director of the United States Patent and Trademark Office*